US011596939B2

(12) United States Patent
Tulp et al.

(10) Patent No.: US 11,596,939 B2
(45) Date of Patent: Mar. 7, 2023

(54) LAMP COMPONENT DISTRIBUTION IN A MICROFLUID CELL

(71) Applicant: SelfDiagnostics Deutschland GmbH, Leipzig (DE)

(72) Inventors: Indrek Tulp, Tartu (EE); Clemens Kremer, Berlin (DE); Grit Rehbein, Halle/Saale (DE); Christin Münch, Hartha (DE); Cindy Baumann, Leipzig (DE); Katrin Krõlov, Leipzig (DE)

(73) Assignee: SELFDIAGNOSTICS DEUTSCHLAND GMBH, Leipzig (DE)

( * ) Notice: Subject to any disclaimer, the term of this patent is extended or adjusted under 35 U.S.C. 154(b) by 39 days.

(21) Appl. No.: 16/500,797

(22) PCT Filed: Apr. 4, 2018

(86) PCT No.: PCT/EP2018/058575
§ 371 (c)(1),
(2) Date: Oct. 3, 2019

(87) PCT Pub. No.: WO2018/185143
PCT Pub. Date: Oct. 11, 2018

(65) Prior Publication Data

US 2020/0222901 A1 Jul. 16, 2020

(30) Foreign Application Priority Data

Apr. 4, 2017 (DK) ..... PA 2017 70244

(51) Int. Cl.
*B01L 3/00* (2006.01)

(52) U.S. Cl.
CPC ..... *B01L 3/502707* (2013.01); *B01L 3/50273* (2013.01); *B01L 3/502738* (2013.01);
(Continued)

(58) Field of Classification Search
CPC ..... B01L 3/502707; B01L 3/50273; B01L 3/502738; B01L 2200/16;
(Continued)

(56) References Cited

U.S. PATENT DOCUMENTS

2006/0246493 A1 11/2006 Jensen
2009/0286327 A1* 11/2009 Cho ..... G01N 21/07 436/174
2013/0309679 A1* 11/2013 Ismagilov ..... B01L 3/5027 435/6.12

FOREIGN PATENT DOCUMENTS

CN 101126765 2/2008
EP 2 128 614 A1 12/2009
(Continued)

OTHER PUBLICATIONS

Amplicon (https://ampliqon.com/en/pcr-enzymes/pcr-enzymes/glycerol-free-products/taq-dna-pol-glycerol-free-5-u/). Downloaded on Nov. 5, 2021 (Year: 2016).*
(Continued)

*Primary Examiner* — Jennifer Wecker
*Assistant Examiner* — Oyeleye Alexander Alabi
(74) *Attorney, Agent, or Firm* — Knobbe, Martens, Olson & Bear LLP

(57) ABSTRACT

A microfluidic test device has a body, a first chamber having an outlet provided with a first valve and holding a first buffer having a first buffer volume, a primary reaction chamber, a sample inlet for receiving and feeding a sample having a sample volume, into the microfluidic test device, a first fluid path connecting the outlet of the first chamber and the sample inlet, a second fluid path connecting the sample inlet and the primary reaction chamber, a primary test part having a primary test chamber, a third primary fluid path connecting the primary reaction chamber and the primary test part, a primary valve arranged in the third primary fluid path, a flow
(Continued)

driving device configured to move fluid from the primary reaction chamber to the primary test part, and a heating assembly configured to heat a reaction fluid in the primary reaction chamber.

13 Claims, 12 Drawing Sheets

Specification includes a Sequence Listing.

(52) U.S. Cl.
CPC ... *B01L 2200/16* (2013.01); *B01L 2300/0816* (2013.01); *B01L 2400/0475* (2013.01); *B01L 2400/06* (2013.01)

(58) Field of Classification Search
CPC ..... B01L 2300/0816; B01L 2400/0475; B01L 2400/06; B01L 2300/0864; B01L 7/52; B01L 3/5027
See application file for complete search history.

(56) References Cited

FOREIGN PATENT DOCUMENTS

| | | | | |
|---|---|---|---|---|
| WO | WO 2004/065010 A2 | | 8/2004 | |
| WO | WO 2013/067272 A1 | | 5/2013 | |
| WO | WO 2014/182847 A1 | | 11/2014 | |
| WO | WO 2015/061480 A1 | | 4/2015 | |
| WO | WO-2015061480 A1 | * | 4/2015 | ..... B01L 3/502738 |
| WO | WO 2016/172724 A1 | | 10/2016 | |

OTHER PUBLICATIONS

Search Report, dated Jun. 8, 2017, in Danish Patent Application No. PA 2017 70244.
International Search Report & Written Opinion, dated Jun. 8, 2018, in International Application No. PCT/EP2018/058575.

* cited by examiner

LAMP COMPONENT DISTRIBUTION IN A MICROFLUID CELL

PRIORITY AND CROSS REFERENCE TO RELATED APPLICATIONS

This application is the U.S. National Stage Application under 35 U.S.C. § 371 of International Application No. PCT/EP2018/058575, filed Apr. 4, 2018, designating the U.S. and published in English as WO 2018/185143 A1 on Oct. 11, 2018, which claims the benefit of Danish Patent Application No. DK PA 2017 70244, filed Apr. 4, 2017. Any and all applications for which a foreign or a domestic priority is claimed is/are identified in the Application Data Sheet filed herewith and is/are hereby incorporated by reference in their entirety under 37 C.F.R. § 1.57.

SEQUENCE LISTING IN ELECTRONIC FORMAT

The present application is being filed along with an Electronic Sequence Listing as an ASCII text file via EFS-Web. The Electronic Sequence Listing is provided as a file entitled AERA010001APCSEQLIST.txt, created and last saved on Oct. 2, 2019, which is 1,096 bytes in size. The information in the Electronic Sequence Listing is incorporated herein by reference in its entirety.

FIELD

The present invention pertains to a microfluidic medical test device with dry substance(s) and buffers arranged inside the microfluidic medical test device for interaction with a sample feed into the medical test device. The device may be optimised for diagnosing sexually transmitted diseases by use of LAMP amplification and flow strip reads.

BACKGROUND

Microfluidic flow cells are being used increasingly as "minilabs" for the analysis, especially in the field of diagnostics. These medical test devices may contain reactive substances in liquid and/or solid form, which are introduced into the flow cells during the production of the cells. Dehydration is known to preserve the function of enzymes during storage above freezing, but the art is highly unpredictable.

Lyophilisation or freeze-drying is a well-known technique for preserving a wide range of moieties including chemicals, bio-chemicals and biological samples. It is also well known that these moieties need to be mixed with reagents such as stabilisers. A variety of stabilisers are known, and these are required to ensure that during the freeze-drying process, the moieties retain their structure and function.

To introduce a dry reagent, one of the assembly steps may involve applying a reagent liquid, that is, a carrier liquid in which a reagent is dissolved or suspended and which is later to be dried, to the area intended to hold the dry reagent inside the flow cell, e.g., a channel or a chamber, while that area is still accessible.

After that, the entire flow cell component, only part of which has been wetted with the reagent, is subjected to a drying process before the further assembly steps are carried out. This drying step may be associated with a heat treatment to accelerate the process, or it may take the form of a freeze-drying process to protect the reagents and ensure the stability and re-suspendability properties of the reagent.

A method for introducing a dry substance into a flow cell as described above is explained in, for example, EP2198964 and US2016167047.

US 2009/0286327 disclose a microfluidic device having a different order of the flow path, wherein a reagent is lyophilized in the third chamber.

SUMMARY

The invention provides microfluidic devices integrated with e.g. dry matter, which can be produced through the manufacturing environment more easily than by the prior art without adverse effects on the dry substance or other components of the flow cell, and which for example have a commercially useful shelf life at room temperature and used as a POC without any worries for experimental errors.

In its broadest aspect, the present invention relates to a microfluidic test device comprising

- a body;
- a first chamber having an outlet provided with a first valve and holding a first buffer having a first buffer volume;
- a primary reaction chamber;
- a sample inlet for receiving a sample and being configured for feeding a sample having a sample volume, into the device;
- a first fluid path connecting the outlet of the first chamber and the sample inlet;
- a second fluid path connecting the sample inlet and the primary reaction chamber;
- a primary test part comprising a primary test chamber;
- a third primary fluid path connecting the primary reaction chamber and the primary test part;
- a primary valve arranged in the third primary fluid path; and
- a flow driving device configured to move fluid from the primary reaction chamber to the primary test part, and wherein the microfluidic test device comprises a primary reaction material in a lyophilized form, and wherein the primary reaction material and the first buffer are arranged on different sides of the sample inlet.

Splitting the primary reaction material in the lyophilized form and the first buffer on different sides of the sample provides for POC detection of e.g. sexually transmitted diseases like Chlamydia in less than an hour yet still having a sensitivity higher than 70% and a specificity near to 100%.

Another advantage is typically preservation of the materials and buffers for long term storage in the test device or making the device more convenient for transport.

DETAILED DESCRIPTION

Figure 1:
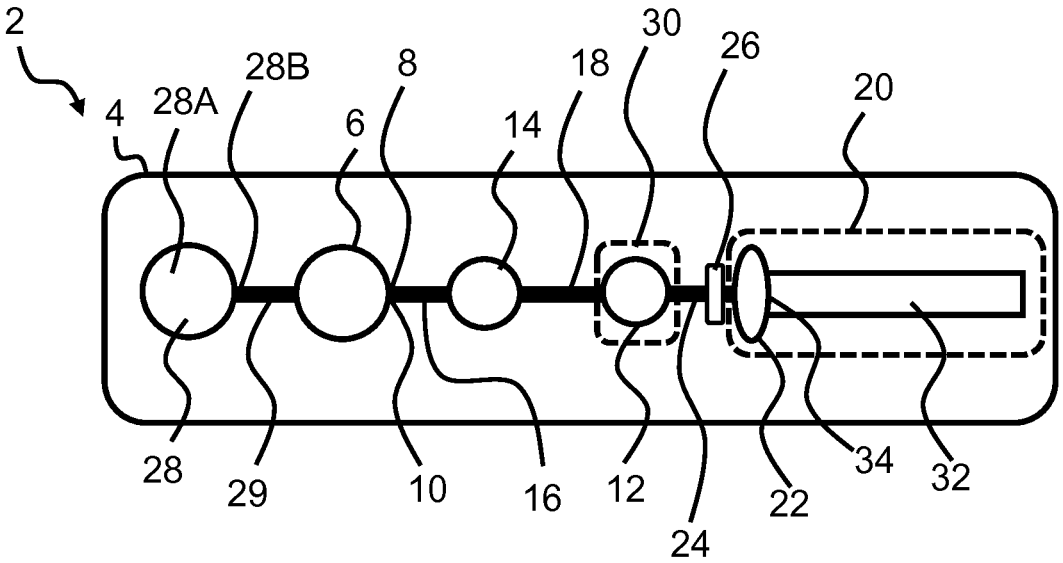
FIG. 1 schematically illustrates a first (top) view of an exemplary microfluidic test device.

The present invention relates to splitting the components in a microfluidic test device, which is a useful approach to stabilize sensitive components by lyophilisation and simultaneously exclude substances that would corrupt the lyophilisation process, but still is needed for the amplification such as LAMP.

Microfluidic Test Device

The microfluidic test device may be a point-of-care (POC) microfluidic test device. Point-of-care testing (POCT), or bedside testing is defined as medical diagnostic testing at or near the point of care—that is, at the time and place of patient care. This contrasts with the historical pattern in which testing was wholly or mostly confined to the medical laboratory, which entailed sending off specimens away from the point of care and then waiting hours or days to learn the results, during which time care must continue without the desired information. Point-of-care tests are simple medical tests that can be performed at the bedside.

Housing

The microfluidic test device may comprise a housing, wherein the body, e.g. with foils, is accommodated within the housing. The housing may have one or more openings to allow access to the inside of the housing, e.g. to the sample inlet.

Button

One or more button members may be included in the housing. A first button of the housing may be associated with the first chamber and/or a second button of the housing may be associated with the flow driving device.

Body

The microfluidic test device comprises a body. The body may be an elongated body having a first end and a second end. The body may have a first end surface and/or a second end surface. The body may have one or more first surfaces, e.g. a first primary surface and/or a first secondary surface, and one or more second surface(s). The first surface(s) may be intended for facing upwards when the microfluidic test device is positioned in a test position. The second surface(s) may be intended for facing downwards when the microfluidic test device is positioned in a test position. The body may comprise one or more grooves or recesses, also denoted first groove(s), in the first surface(s). The body may comprise one or more grooves or recesses, also denoted second groove(s), in the second surface(s). The first and/or second grooves may form at least a part of the fluid paths of the microfluidic test device. The body may have one or more through-going bores from first surface(s) to second surface(s). The body one or more through-going bores may form at least a part of the fluid paths of the microfluidic test device.

The body may be made of a body material. The body material may be glass, silicon, or a polymer, such as Polydimethylsiloxane (PDMS). In one or more exemplary microfluidic test devices, the body is made of polypropylene (PP). The body material may be black or grey. A black or grey PP body material is cheap and has good laser welding properties, in turn reducing welding time.

Foils

The microfluidic test device may comprise one or more first foils, such as a first primary foil and/or a first secondary foil, attached to the first surface(s) of the body. The microfluidic test device may comprise one or more second foils, such as a second primary foil and/or a second secondary foil, on the second surface(s) of the body.

The first foil(s) and/or the second foil(s) may be attached to the body by laser welding. The first foil(s) may have a thickness in the range from 0.05 mm to 2 mm, such as from 0.2 mm to 0.8 mm. The second foil(s) may have a thickness in the range from 0.05 mm to 2 mm, such as from 0.2 mm to 1.0 mm.

A foil, such as one or more first foils and/or one or more second foil(s) may be made of a flexible material.

The microfluidic test device may comprise a first primary foil attached to the first primary surface of the body. The first primary foil may be made of a first primary foil material. The first primary foil material may be the same as the body material, e.g. to facilitate attachment of the first primary foil to the body. The first primary foil material may be a polymer, such as Polydimethylsiloxane (PDMS). In one or more exemplary microfluidic test devices, the first primary foil is made of polypropylene (PP). The first primary foil material may be transparent. A transparent first primary foil material allows a user to inspect or follow liquid flow in fluid paths partly formed by the first primary foil. Further, a user can read test results through a transparent first primary foil material covering and/or sealing one or more openings in the body.

The microfluidic test device may comprise a first secondary foil attached to the first secondary surface of the body. The first secondary foil may be made of a first secondary foil material. The first secondary foil material may be metal material or an alloy. In one or more exemplary microfluidic test devices, the first secondary foil is made of aluminium.

The microfluidic test device may comprise a second primary foil attached to the second surface of the body. The second primary foil may be made of a second primary foil material. The second primary foil material may be the same as the body material, e.g. to facilitate attachment of the second primary foil to the body. The second primary foil material may be a polymer, such as Polydimethylsiloxane (PDMS). In one or more exemplary microfluidic test devices, the second primary foil is made of polypropylene (PP). The second primary foil material may be transparent.

A transparent second primary foil material allows a user to inspect or follow liquid flow in fluid paths partly formed by the second primary foil.

First Chamber

The microfluidic test device comprises a first chamber having an outlet and holding a first buffer having a first buffer volume. The outlet of the first chamber may be provided with a first valve. The first valve may be configured to open when the pressure on the inlet side of the first valve is larger than a first pressure threshold. The first chamber may have a first volume in the range from 10 microliters to 900 microliters. In one or more exemplary microfluidic test devices, the first chamber has a first volume in the range from 30 microliters to 1,000 microliters, such as 300 microliters, 400 microliters, 500 microliters, or 600 microliters, 700 microliters, 800 microliters, 900 microliters, or any ranges there between.

The First Buffer—Blister Buffer

The first buffer may comprise components useful in amplifying a nucleotide target in the sample. In one exemplary, such amplification is provided by Loop-mediated isothermal amplification (LAMP). In LAMP, the target sequence is amplified at a constant temperature typically 60-65° C. using either two or three sets of primers and a polymerase with high strand displacement activity in addition to a replication activity. Typically, 4 different primers are used to identify 6 distinct regions on the target gene, which adds highly to the specificity. An additional pair of "loop primers" can further accelerate the reaction. Due to the specific nature of the action of these primers, the amount of DNA produced in LAMP is considerably higher than PCR based amplification.

The first buffer optionally comprises a neutral chemical compound with a positively charged cationic functional group such as a quaternary ammonium or phosphonium cation (generally: onium ions) which bears no hydrogen atom and optionally with a negatively charged functional group such as a carboxylate group which may not be adjacent to the cationic site. The neutral chemical compound may be Betaine.

The first buffer optionally comprises one or more inorganic salts, such as but not limited to MgSO4 and/or (NH4)2SO4.

In one exemplary, the first buffer comprises (NH4)2SO4, a zwitterion, and a biocide.

A zwitterion in the present context is a neutral molecule with both positive and negative electrical charges. In some cases, multiple positive and negative charges may be present. Unlike simple amphoteric compounds that may only form either a cationic or anionic species, a zwitterion simultaneously has both ionic states. Zwitterions are distinct from molecules that have dipoles at different locations within the molecule. Zwitterions are sometimes called inner salts. Zwitterions containing quaternary-ammonium centres are common in biology, a common example are the betaines.

In one exemplary, the first buffer comprises (NH4)2SO4, betaine, and a biocide.

A biocide in the present context relates to a chemical substance intended to destroy, deter, render harmless, or exert a controlling effect on any harmful organism by chemical or biological means.

In one exemplary, the first buffer comprises (NH4)2SO4, betaine, and a biocide.

A useful example of a biocide of the present invention is 2-Methyl-4-isothiazolin-3-one, commercially known as ProClin95, and functions by immediately upon microstatic contact with microbial organisms as a result of their ability to quickly penetrate cell membranes and inhibit specific enzymes crucial to cellular respiration. Multiple specific sites of ProClin toxicity prevent microorganisms from developing high levels of resistance, making ProClin highly efficient even over extended storage periods IVD components.

In one exemplary, the first buffer comprises $(NH_4)_2SO_4$, betaine, and a 2-Methyl-4-isothiazolin-3-one.

The first buffer is present in a blister, pressed to first flushes out the urine from the sample plug, mixes up with the urine, divides into two equal volumes and finally enters the reaction chambers including the reagent pellets and solves the pellets. Thus, the reaction chambers do not comprise liquids prior to the action of the user.

Accordingly, in one exemplary, the invention relates to a microfluidic test as described herein with the proviso that the primary reaction chamber is (substantially) free of liquid, such as a buffer, prior to feeding a sample into the device.

In one exemplary, the invention relates to a microfluidic test as described herein with the proviso that the primary reaction chamber is (substantially) free the first buffer prior to feeding a sample into the device.

Thus, the microfluidic test device is (substantially) free of (NH4)2SO4 and/or zwitterions (preferably betaine) and/or biocides prior to feeding a sample into the device.

Reaction Chamber

The microfluidic test device comprises one or more reaction chambers including a primary reaction chamber. The primary reaction chamber may have a volume larger than 20 microliters and/or less than 500 microliters. In one or more exemplary microfluidic test devices, the primary reaction chamber may have a volume in the range from 40 microliters to 200 microliters, such as 50 microliters, 75 microliters, 100 microliters, 125 microliters, 150 microliters, 175 microliters, or any ranges there between. The microfluidic test device may comprise a primary reaction chamber plug forming a part of the primary reaction chamber. A microfluidic test device with reaction chamber plugs facilitates positioning of reaction material in reaction chamber(s). For example, a pellet with reaction material, such as a primary pellet with primary reaction material may be placed in a primary reaction chamber body part followed by a closing of the primary reaction chamber with a primary reaction chamber plug.

Reaction Material—Pellet

The microfluidic test device may comprise reaction material arranged or deposited at different positions in the microfluidic test device.

The microfluidic test device may comprise a primary reaction material. The primary reaction material may be arranged in the primary reaction chamber.

The primary reaction material optionally comprises short strands of RNA and/or DNA (generally about 18-22 bases) that serve as a starting point for DNA synthesis. In one or more exemplary microfluidic test devices, the primary reaction material comprises nucleoside triphosphate (NTP). In one or more exemplary microfluidic test devices, the primary reaction material comprises Deoxynucleosidtriphosphates (dNTPs).

In one or more exemplary microfluidic test devices, the primary reaction material comprises an enzyme capable of synthesising chains or polymers of nucleic acids, optionally in combination with NTP/dNTPs and/or short strands of RNA and/or DNA.

The enzyme capable of synthesising chains or polymers of nucleic acids may be a LAMP polymerase.

The primary reaction material may be subjected to a freeze-drying process to protect the reagents and ensure the stability and re-suspendability properties of the reagent(s) prior to the introduction of the reagent into the primary reaction chamber.

Thus, in one or more exemplary microfluidic test devices, the primary reaction material is in a dry and/or pellet like form.

The primary reaction material may be coated onto a surface of the body and/or a foil of the microfluidic test device, wherein the primary reaction material and the first buffer are arranged on different sides of the sample inlet.

The primary reaction material also known as the pellet, may consist of the lyophilized form of a reaction buffer (typically TrisHCl [pH 8.8 at 25° C.], KCl, MgSO4, Tween 20), dNTPs, PrimerMix, and the polymerase. However, while testing the ammonium ions placement, as shown in Example 2, the present inventors identified that $(NH_4)_2SO_4$ could be disadvantageous for the stability of the pellet.

The primary reaction material may be placed in a pellet form (cake) in the reaction chamber and/or coated to an inner surface of the microfluidic test device. The primary reaction material itself may be split between the reaction chamber and an inner surface of the microfluidic test device.

In one exemplary, all the primary reaction material is placed in the primary reaction chamber.

Magnesiumsulfat Heptahydrat could be present both in the primary reaction material and the first buffer. In one exemplary, $Mg(SO_4)7H_2O$ (Magnesiumsulfat Heptahydrat) is present in both the primary reaction material and the first buffer in a ratio 1:3.

The pellet will be re-suspended and mixed with the urine and first buffer mixture due to microfluidic forces and heated, typically to 50-70° C., to enable the amplification process of the target.

Thus, in one exemplary the primary reaction material components may comprise primers, dNTPs, and a polymerase.

In one exemplary the primary reaction material components may enable amplification of a nucleic acid target by loop-mediated isothermal amplification (LAMP).

The Loop-mediated isothermal amplification (LAMP) method as described herein stands out to be a novel, highly sensitive and specific diagnostic tool because of the ease of performing and capability to diagnose a negligible amount of pathogen genetic material preferably within an hour.

The LAMP method of the present invention has several advantages over the widely-used PCR.

The LAMP method of the present invention is carried out at a constant temperature (typically 55-65° C.) and does not require a thermal cycler. The temperature is typically around 60° C., such as 55-65° C., or 58-63° C. In some embodiments, the temperature is 55° C., 56° C., 57° C., 58° C., 59° C., 60° C., 61° C., 62° C., 63° C., 64° C. and/or 65° C.

The LAMP method of the present invention uses 4-6 different primers (2 inner, 2 outer and/or 2 additional loop primers) and a polymerase with a strand displacement activity to identify 6 distinct regions on the target gene sequence. This allows generating an amplification product containing of single-stranded loop regions, where primers can bind without template denaturation. The additions of loop primers significantly accelerate amplification, increasing sensitivity and reducing reaction time.

The amount of DNA product at the end of the LAMP reaction of the present invention is considerably higher that than in PCR and can be simply visualized using metal ion indicators like calcein or such DNA binding dyes as SYBR green, ethidium bromide, picogreen, propidium iodide, hydroxy naphthol blue.

Depending on primer choice, not only DNA but also RNA can be amplified. Thus, even pathogen specific RNA can be targeted as well with current invention.

Polymerases

The LAMP method of the present invention is using elevated temperature (usually between 55-65° C.) and for that, a thermophilic DNA polymerase is required. These polymerases should have a strong strand displacement activity. These polymerases are not suitable for use in PCR. Not all thermostable DNA polymerase are suitable for urinary analysis.

For urinary analysis, it is important to use a polymerase, which have minimum activity loss due to urine matrix effect. Comparing urine tolerance of different polymerases shows that particularly Omi Amp, Tin and SD polymerases lose their activity entirely already on low levels of urine. Other polymerases start to lose their activity significantly on urine levels 10% and more. While Bsm DNA polymerase is most resistant to urine.

The present inventors reviewed numerous polymerases for appliances in microfluid based LAMP testing's and small quantities of urine even enhance Bsm DNA polymerase activity and thus this polymerase is very suitable for urinary analysis in the device of the present invention.

In a presently preferred embodiment of the present invention, the polymerase used in the LAMP is a Bsm DNA polymerase. In the present context, a Bsm DNA polymerase is a DNA polymerase of *Bacillus smithii*, which catalyzes 5'→3' synthesis of DNA and lacks 5'→3' and 3'→5' exonuclease activities.

In another embodiment, then the Bsm DNA polymerase is a Bsm DNA Polymerase, Large Fragment. In the present context, a Bsm DNA Polymerase, Large Fragment is a portion of DNA polymerase of *Bacillus smithii*, which catalyzes 5'→3' synthesis of DNA and lacks 5'→3' and 3'→5' exonuclease activities. Bsm DNA Polymerase, Large Fragment has a strong strand displacement activity and is active in a wide range of temperatures from 30° C. to 63° C., with an optimum of activity at 60° C. Bsm DNA Polymerase, Large Fragment is an enzyme with high functional similarity to Bst DNA Polymerase, Large Fragment and can replace it in most applications.

In one embodiment, the present invention relates to a Loop-Mediated Isothermal Amplification integrated on a microfluidic chip for Point-of-Care quantitative detection of pathogens, wherein the polymerase is a Bsm DNA polymerase.

Sample Inlet

The microfluidic test device comprises a sample inlet for receiving a sample. The sample inlet is configured for feeding a sample having a sample volume, into the medical test device.

Fluid Paths

The microfluidic test device comprises a first fluid path. The first fluid path may connect the outlet of the first chamber and the sample inlet. The first fluid path may comprise a first branch and a second branch in parallel to the first branch. The first branch of the first fluid path may be connected to a first inlet of sample chamber formed by sample inlet and sample plug. Thus, the first branch may feed first buffer into the sample chamber via first inlet. The second branch of the first fluid path may be connected to a second inlet of sample chamber formed by sample inlet and sample plug. Thus, the second branch of the first fluid path may feed first buffer into the sample chamber via second inlet. A plurality of branches in the first fluid path, the branches connected to respective sample chamber inlets in the microfluidic test device provides improved flushing of the sample. In one or more exemplary microfluidic test devices, the sample chamber only has a single inlet.

The microfluidic test device comprises a second fluid path. The second fluid path may connect the sample inlet and the primary reaction chamber. The second fluid path may comprise a first branch and a second branch in parallel to the first branch. The first branch and the second branch of the second fluid path are optionally connected to respective first outlet and second outlet of the sample chamber. Thus, liquid from the sample chamber may enter the first branch and the second branch of the second fluid path via respective first outlet and second outlet of the sample chamber. The first branch and the second branch of the second fluid path may be joined in second fluid path joint to a single fluid path part, optionally before splitting into second primary fluid path and second secondary fluid path. In one or more exemplary microfluidic test devices, the second primary fluid path is directly connected to first outlet of sample chamber and the second secondary fluid path is directly connected to the second outlet of sample chamber. In one or more exemplary microfluidic test devices, the sample chamber only has a single outlet that may later be branched into second primary fluid path and second secondary fluid path.

The microfluidic test device comprises a primary test part comprising a primary test chamber.

The microfluidic test device comprises a third primary fluid path optionally connecting the primary reaction chamber and the primary test part.

Valves

The microfluidic test device may comprise a primary valve arranged in the third primary fluid path. The primary valve acts as a blocking mechanism to separate the primary test part and liquid (sample, first buffer and reaction material) during a reaction time. The primary valve may be configured to open when the pressure on the inlet side of the primary valve is larger than a primary pressure threshold. The microfluidic test device comprises a flow driving device configured to move fluid (primary test liquid) from the primary reaction chamber to the primary test part.

Thus, a user operating the flow driving device may be able to break or force primary valve to open.

Heating Assembly and Elements

The microfluidic test device optionally comprises a heating assembly configured to heat a (primary) reaction fluid in the primary reaction chamber.

The heating assembly may be configured to heat the (primary) reaction fluid in the primary reaction chamber to a primary reaction temperature in the range from 30° C. to 100° C., preferably in the range from 30° C. to 70° C., such as in the range from 45° C. to 68° C. In one or more exemplary microfluidic test devices, the primary reaction temperature is in the range from 55° C. to 65° C., such as from 58° C. to 63° C. In one or more exemplary microfluidic test devices, the primary reaction temperature is 55° C., 56° C., 57° C., 58° C., 59° C., 60° C., 61° C., 62° C., 63° C., 64° C. and/or 65° C.

The heating assembly may comprise one or more heating elements, such as one or more primary heating elements, e.g. for heating the primary reaction chamber. The heating assembly may comprise a primary heating element adjacent the primary reaction chamber.

The primary heating element may be configured to self-regulate to a primary temperature, e.g. upon application of a primary voltage. The primary temperature may be in the range from 30° C. to 100° C., preferably in the range from 30° C. to 80° C., such as in the range from 45° C. to 75° C. In one or more exemplary microfluidic test devices, the primary temperature is in the range from 55° C. to 70° C., such as from 58° C. to 67° C. In one or more exemplary microfluidic test devices, the primary temperature is 55° C., 56° C., 57° C., 58° C., 59° C., 60° C., 61° C., 62° C., 63° C., 64° C. and/or 65° C. In one or more exemplary microfluidic test devices, the primary voltage is in the range from 0.5V to 5V, such as in the range from 1.5V to 3.5 V, e.g. 3V A self-regulating primary heating element reduces or eliminates the need for electrical control circuitry, in turn providing a simple temperature control.

The microfluidic test device may comprise a first terminal and a second terminal. The primary heating element may be connected to the first terminal (first side and/or first end of primary heating element) and the second terminal (second side and/or second) end of primary heating element) for applying a voltage to the heating assembly, such as the primary heating element.

The heating assembly, e.g. when configured for two-reaction chamber heating, may have a length in the range from 15 mm to 50 mm, such as from 20 mm to 30 mmm e.g. 24 mm. The heating assembly, e.g. when configured for two-reaction chamber heating, may have a width in the range from 5 mm to 30 mm, such as from 10 mm to 20 mmm e.g. 11 mm. The heating assembly may have a thickness in the range from 0.2 mm to 3 mm.

The heating assembly may comprise a first electrode layer arranged on a first side of the primary heating element. The heating assembly may comprise a second electrode layer arranged on a second side of the primary heating element. Thus, the primary heating element may be sandwiched between the first electrode layer and second electrode layer for applying a primary voltage to the primary heating element. The first electrode layer (and thus the primary heating element) and second electrode layer (and thus the primary heating element) may be respectively connected to first terminal and second terminal. The first terminal and the second terminal may be arranged in a battery docket of the microfluidic test device. The first terminal and the second terminal may be arranged in a connector for connecting an external power source to the microfluidic test device. The first electrode layer and/or the second electrode layer may be made of a suitable electrode material, such as copper, nickel or an alloy comprising copper and/or nickel.

The heating assembly, e.g. first electrode layer of the heating assembly, may be attached to the second primary foil, e.g. by gluing. The heating assembly may be adjacent to and/or overlapping the primary and secondary reaction chambers. The primary heating element may comprise a resin material and/or one or more polymers. The primary heating element may comprise a carbon-based heater resin.

The primary heating element may be made of a material with positive temperature coefficient of resistance. The primary heating element may comprise a ceramic element, such as a positive temperature coefficient (PCT) ceramic. The ceramic element may be made of, based on, or comprise barium titanate (BaTiO3).

Secondary Parts

In one or more exemplary microfluidic test devices, the microfluidic test device comprises a secondary reaction chamber. The secondary reaction chamber may have a volume larger than 20 microliters and/or less than 500 microliters. In one or more exemplary microfluidic test devices, the secondary reaction chamber may have a volume in the range from 40 microliters to 200 microliters, such as 50 microliters, 75 microliters, 100 microliters, 125 microliters, 150 microliters, 175 microliters, or any ranges there between. The microfluidic test device may comprise a secondary reaction chamber plug forming a part of the secondary reaction chamber.

The second fluid path may connect the sample inlet and the secondary reaction chamber. For example, the second fluid path may be Y-shaped with a first end connected to the sample inlet, a primary second end connected to the primary test part, and a secondary second end connected to the secondary reaction chamber. The microfluidic test device may comprise a secondary test part comprising a secondary test chamber.

The microfluidic test device may comprise a third secondary fluid path connecting the secondary test part and one or more reaction chambers, such as the primary reaction chamber and/or the secondary reaction chamber. The microfluidic test device may comprise a secondary valve arranged in the third secondary fluid path. The flow driving device may be configured to move fluid from the primary reaction chamber to the secondary test part. The flow driving device may be configured to move fluid from the secondary reaction chamber to the secondary test part.

The secondary valve acts as a blocking mechanism to separate the secondary test part and liquid (sample, first buffer and reaction material) during a reaction time. The secondary valve may be configured to open when the pressure on the inlet side of the secondary valve is larger than a secondary pressure threshold. Thus, a user operating the flow driving device may be able to break or force secondary valve to open.

The microfluidic test device may comprise a secondary reaction material. The secondary reaction material may be arranged in the secondary reaction chamber. The secondary reaction material may be the same as or different from the first reaction material.

The secondary reaction material optionally comprises short strands of RNA and/or DNA (generally about 18-22 bases) that serve as a starting point for DNA synthesis. In one or more exemplary microfluidic test devices, the secondary reaction material comprises nucleoside triphosphate (NTP). In one or more exemplary microfluidic test devices, the secondary reaction material comprises Deoxynucleoside triphosphates (dNTPs). In one or more exemplary microfluidic test devices, the secondary reaction material comprises an enzyme capable of synthesising chains or polymers of nucleic acids, optionally in combination with NTP/dNTPs and/or short strands of RNA and/or DNA.

The enzyme capable of synthesising chains or polymers of nucleic acids may be a LAMP polymerase.

The secondary reaction material may be subjected to a freeze-drying process to protect the reagents and ensure the stability and re-suspendability properties of the reagent(s) prior to the introduction of the reagent into the secondary reaction chamber. Thus, in one or more exemplary microfluidic test devices, the secondary reaction material is in a dry and/or pellet like form.

The heating assembly may be configured to heat a (secondary) reaction fluid in the secondary reaction chamber to a secondary reaction temperature in the range from 30° C. to 100° C., preferably in the range from 30° C. to 70° C., such as in the range from 45° C. to 68° C. In one or more exemplary microfluidic test devices, the secondary reaction temperature is in the range from 55° C. to 65° C., such as from 58° C. to 63° C. In one or more exemplary microfluidic test devices, the secondary reaction temperature is 55° C., 56° C., 57° C., 58° C., 59° C., 60° C., 61° C., 62° C., 63° C., 64° C. and/or 65° C.

The first primary heating element may be configured to heat the secondary reaction chamber. The heating assembly may comprise one or more heating elements, such as one or more secondary heating elements, e.g. for heating the secondary reaction chamber. The heating assembly may comprise a secondary heating element adjacent the secondary reaction chamber. The primary heating element may be adjacent the secondary reaction chamber.

The secondary heating element may comprise a resin material and/or one or more polymers. The secondary heating element may comprise a carbon-based heater resin. The secondary heating element may be made of a material with positive temperature coefficient of resistance. The secondary heating element may comprise a ceramic element, such as a positive temperature coefficient (PCT) ceramic. The ceramic element may be made of, based on, or comprise barium titanate (BaTiO3).

The secondary heating element may be configured to self-regulate to a secondary temperature, e.g. upon application of a secondary voltage. The secondary temperature may be the same as or different from the primary temperature. The secondary temperature may be in the range from 30° C. to 100° C., preferably in the range from 30° C. to 80° C., such as in the range from 45° C. to 75° C. In one or more exemplary microfluidic test devices, the primary temperature is in the range from 55° C. to 70° C., such as from 58° C. to 67° C. In one or more exemplary microfluidic test devices, the primary temperature is 55° C., 56° C., 57° C., 58° C., 59° C., 60° C., 61° C., 62° C., 63° C., 64° C. and/or 65° C. In one or more exemplary microfluidic test devices, the secondary voltage is the same as or different from the primary voltage. The secondary voltage may be in the range from 0.5V to 5V, such as in the range from 1.5V to 3.5 V, such as 3V. A self-regulating primary heating element reduces or eliminates the need for electrical control circuitry, in turn providing a simple temperature control. Thus, the microfluidic test device enables different tests with different test temperatures in the same microfluidic test device. Primary and/secondary voltages less than 5V may be advantageous for a POCT device, e.g. for a battery-driven POCT device.

The flow driving device may comprise a second chamber having an outlet optionally provided with a second valve, wherein the outlet of the second chamber is connected to the first fluid path or the second fluid path. The second valve may be configured to open when the pressure on the inlet side of the second valve is larger than a second pressure threshold. Thus, the microfluidic test device may comprise a fourth fluid path connecting the outlet of the second chamber and the first fluid path or the second fluid path. In one or more exemplary microfluidic test devices, the second chamber has a second volume in the range from 30 microliters to 2,000 microliters, such as 300 microliters, 400 microliters, 500 microliters, 600 microliters, 800 microliters, 1,000 microliters, 1,20 microliters, 1,400 microliters, 1,600 microliters, 1,800 microliters, or any ranges there between. The microfluidic test device may comprise a second fluid, such as air and/or liquid in the second chamber.

Seal Covering the Sample Inlet

The microfluidic test system may comprise a seal covering the sample inlet. The seal may be peeled off, removed or broken prior to or just prior to testing by inserting a sample plug into the microfluidic test device. Thus, the risk of contaminating the inside of the microfluidic test device may be reduced.

Test Part

A test part of the microfluidic test device, such as the primary test part and/or the secondary test part may comprise a second lateral flow strip. Thus, the primary test part may comprise a first lateral flow strip having a first end connected to or inserted into an outlet of the primary test chamber. The secondary test part may comprise a second lateral flow strip having a first end connected to or inserted into an outlet of the secondary test chamber. A plurality of lateral flow strips enables detection of faulty tests and/or enables performance of different tests on a single sample.

The first lateral flow strip may have a length in the range from 30 mm to 100 mm, such as in the range from 40 to 80 mm. In one or more exemplary microfluidic test devices, the first lateral flow strip has a length in the range from 60 mm to 70 mm. The first lateral flow strip may have a width in the range from 1 mm to 10 mm, such as in the range from 1.5 mm to 4.0 mm. Narrow lateral flow strips have reduced requirements for liquid volume. In one or more exemplary microfluidic test devices, the first lateral flow strip has a width in the range from 2.0 mm to 3.5 mm, such as 3.0 mm.

The second lateral flow strip may have a length in the range from 30 mm to 100 mm, such as in the range from 40 to 80 mm. In one or more exemplary microfluidic test devices, the second lateral flow strip has a length in the range from 60 mm to 70 mm. The second lateral flow strip may have a width in the range from 1 mm to 10 mm, such as in the range from 1.5 mm to 4.0 mm. Narrow lateral flow strips have reduced requirements for liquid volume. In one or more exemplary microfluidic test devices, the second lateral flow strip has a width in the range from 2.0 mm to 3.5 mm, such as 3.0 mm.

Lateral flow strips in the present context are simple devices intended to detect the presence (or absence) of a target analyte in sample (matrix) without the need for specialized and costly equipment.

Typically, these tests are used for medical diagnostics either for home testing, point of care testing, or laboratory use. A widely spread and well known application is the home pregnancy test.

The technology is based on a series of capillary beds, such as pieces of porous paper or sintered polymer. Each of these elements has the capacity to transport fluid (e.g., urine) spontaneously. The first element (the sample pad) acts as a sponge and holds an excess of sample fluid. Once soaked, the fluid migrates to the second element (conjugate pad) in which the manufacturer has stored the so-called conjugate, a dried format of bio-active particles in a salt-sugar matrix that contains everything to guarantee an optimized chemical reaction between the target molecule and its chemical partner that has been immobilized on the particle's surface.

While the sample fluid dissolves the salt-sugar matrix, it also dissolves the particles and in one combined transport action the sample and conjugate mix while flowing through the porous structure.

In this way, the analyte binds to the particles while migrating further through the third capillary bed. This material has one or more areas (often called stripes) where a third molecule has been immobilized by the manufacturer. By the time the sample-conjugate mix reaches these strips, analyte has been bound on the particle and the third 'capture' molecule binds the complex. After a while, when more and more fluid has passed the stripes, particles accumulate and the stripe-area typically changes colour.

Lateral flow strip based signal visualization and enhancement is very beneficial on cost perspective, this is presumably the cheapest solution to form simple optical readout that is applicable for point-of-care devices.

While using lateral flow strips for amplicon detection and signal visualization one should also bear in mind that upstream components, including those that are coming from sample matrix, will not inhibit the very binding reaction on lateral flow. This also usually requires balancing of lateral flow buffer and amount of e.g. conjugated gold nanoparticles that are required. Wrong balancing of components will result in signal loss or in nonspecific signals.

Different haptens can be used for the labelling of the primers, including FAM, biotin, DIG, to detect amplification product with lateral flow strips. Using different hapten combination multiple product detection can be achieved (multiplex reaction detecting several different pathogens at once).

Valve

The body may comprise a first valve body part forming a part of the first valve. The first valve body part may be formed as a recess in a surface of the body, such as a first primary surface, a first secondary surface or a second surface of the body. The body may comprise a second valve body part forming a part of the second valve. The second valve body part may be formed as a recess in a surface of the body, such as a first primary surface, a first secondary surface or a second surface of the body. The body may comprise a primary valve body part forming a part of the primary valve. The primary valve body part may be formed as a recess in a surface of the body, such as a first primary surface, a first secondary surface or a second surface of the body.

The body may comprise a secondary valve body part forming a part of the secondary valve. The secondary valve body part may be formed as a recess in a surface of the body, such as a first primary surface, a first secondary surface or a second surface of the body.

The body may comprise a primary test chamber body part forming a part of the primary test chamber. The primary test chamber body part may be formed as a recess in a surface of the body, such as a first primary surface, a first secondary surface or a second surface of the body.

The body may comprise a secondary test chamber body part forming a part of the secondary test chamber. The secondary test chamber body part may be formed as a recess in a recess in a surface of the body, such as a first primary surface, a first secondary surface or a second surface of the body.

Flow Strip Chamber

The body/microfluidic test device may comprise a first flow strip chamber and/or a second flow strip chamber. The first flow strip chamber may be accessible, e.g. for reading test results, through a first opening in a surface of the body, such as a first primary surface, a first secondary surface or a second surface of the body. The second flow strip chamber may be accessible, e.g. for reading test results, through a second opening 70 in a surface of the body, such as a first primary surface, a first secondary surface or a second surface of the body.

The body may comprise one or more holding elements for holding and/or fixate lateral flow strip(s) in position, e.g. between the body and a second foil, such as a second primary foil. The body may comprise one or more first holding elements, such as a first primary holding element and/or a first secondary holding element, in the first flow strip chamber, optionally configured to hold or fixate a first lateral flow strip in position between the body and the second primary foil. The body may comprise one or more second holding elements, such as a second primary holding element and/or a second secondary holding element, in the second flow strip chamber, optionally configured to hold or fixate a second lateral flow strip in position between the body and the second primary foil.

Foils

The first primary foil may comprise a primary valve foil part forming a part of the primary valve. The first primary foil may comprise a secondary valve foil part forming a part of the secondary valve. The first primary foil may comprise a first primary test chamber foil part forming a part (top) of the primary test chamber. The first primary foil may comprise a first secondary test chamber foil part forming a part (top) of the secondary test chamber. The first primary foil may cover and/or seal the first opening in the body. The first primary foil may cover and/or seal the second opening in the body.

The first secondary foil may comprise a first chamber foil part forming a part of the first chamber. The first secondary foil may comprise a second chamber foil part forming a part of the second chamber.

The first secondary foil may comprise a first valve foil part forming a part of the first valve. The first secondary foil may comprise a second valve foil part forming a part of the second valve.

The first primary foil and the first secondary foil may be made of different materials, e.g. to implement different functions in the microfluidic test device.

The second primary foil may comprise a second primary test chamber foil part forming a part (bottom) of the primary test chamber. The second primary foil may comprise a second secondary test chamber foil part forming a part (bottom) of the secondary test chamber.

The second primary foil may comprise a primary reaction chamber foil part forming a part (bottom) of the primary reaction chamber. The second primary foil may comprise a secondary reaction chamber foil part forming a part (bottom) of the secondary reaction chamber. The heating assembly may be attached to the second primary foil. The heating assembly may partly or fully cover the primary reaction chamber foil part and/or the secondary reaction chamber foil part. Thus, efficient heat transfer to the reaction chambers are provided for.

The second primary foil may comprise a sample inlet foil part forming a part (bottom) of the sample inlet.

The second primary foil may comprise a first flow strip chamber foil part forming a part of the first flow strip chamber and/or a second flow strip chamber foil part forming a part of the second flow strip chamber.

The second primary foil may form a part of one or more fluid paths, such as the first, second, third (primary and secondary), and/or fourth fluid paths.

The Packaging Conditions

The composition of the pellet is important for the packaging of the components onto the microfluidic test device. Care should be taken to for example the texture of the pellet.

In one or more exemplary embodiments, the pellets are inserted into the core chip under 2% M/V water vapour-atmosphere. The devices may be single packed in aluminium pouches, which are resistant to oxygen, light and humidity.

The packaging may introduce N2-atmosphere in the packaging to avoid oxygen and humidity inside the packaging.

Betaine needs to be excluded from the reaction mix loaded as pellet on the microfluidic test device, because Betaine could not properly be lyophilised, yet the component is still necessary for the amplification reaction.

Glycerol Removal to Affect An Efficient Freeze-drying Process

The polymerase used in the pellet composition is obtainable from a variety of sources. Generally, however, as supplied, the polymerase is in the form of a wet reagent which includes a range of excipients including detergents, anti-oxidants, anti-reducing agents and significant quantities of solvent which is generally glycerol but in some cases, oligosaccharide solutions are used.

Removal of the glycerol is necessary to affect an efficient freeze-drying process however. The applicants have found that substantially complete removal of glycerol is beneficial to the freeze-drying process, so that the pellet composition is substantially free of glycerol. In particular, the composition should contain less than 5% v/v glycerol, for example less than 4%, 3%, 2%, 1%, 0.5%, 0.22%, 0.11% or 0.01% vv glycerol.

Suitably, the composition is free of glycerol.

Removal of glycerol from commercial polymerase preparations can be effected using a variety of conventional techniques including for instance separation based upon molecular weight, such as dialysis, microfiltration using a membrane or exclusion chromatography for instance on a Sepharose column, or separation based upon affinity techniques such as ligand binding, histidine tagging, or by using specific binding partners such as antibodies or aptamers.

In an exemplary, one or more washing steps using a buffer such as a Tris buffer are carried out during or after the removal procedure to ensure substantially complete removal of glycerol. At this stage, it may be necessary to re-introduce the other agents such as detergent, anti-oxidant and anti-reducing agent that facilitate the activity of the enzyme during the reaction since these components may be lost during such a thorough removal procedure.

Purifying Bsm can be performed with Amicon® Ultra-0.5 Centrifugal Filter Devices, however according to the IFU 5% of the protein can be lost during the purifying. Thus, additional 5% purified Bsm should be estimate in the pellet to compensate this possible issue.

Thus, in one exemplary the Bsm polymerase is lyophilized (substantially) free of glycerol and added to the device with an additional 5% purified Bsm to compensate for the loss during the purification process.

Distributing the components onto the microfluidic test device and arranging the comprises a primary reaction material in a lyophilized form and the first buffer on different sides of the sample inlet did not result in any adverse consequences on the fluidics and thus the read out of the device.

The packaging of the lyophilized components is made under humidity and oxygen free conditions. the liquids are sterile filtrated prior to packaging into the microfluidic test device.

Removal of $MgSO_4$ Avoids Premature Activation of the Polymerase

As disclosed above, magnesium sulfate hydrate could be present both in the primary reaction material and the first buffer in a ratio 1:3.

The issue observed when all the magnesium sulfate hydrate a risk of a potential premature activation of the polymerase. The Bsm polymerase could be activated by high levels of $MgSO_4$ included in the pellet. On the other hand, some $MgSO_4$ in the pellet could support the conservation of e.g. the primers. Removing salts from the pellet allows a much better product for handling during assembly and in-use. The more salts used within the pellet-composition, the more excipients necessary to stabilize the formulation. This then means that the salts and the excipients increase hygroscopic nature of the resulting cake.

Stabilizers/Excipients

The present inventors tested several combinations of stabilizers/excipients for use in microfluidic test devices. Initial tests on 8 different substances tested in (q)LAMP reactions (qLAMP is a quantitative version of LAMP) enables the inventors to see differences more detailed in terms of testing inhibitory issues. The experiments made was set to an acceptance criteria (3 min difference) and in LAMP they all showed 100% positive results (see Table below).

Thus, the present inventors decided to go with a mixture of selected excipients mainly including variant A. Based on our data the best performing excipient composition was decided.

| | H2O | A | B | C | D | E | F | G | H |
|---|---|---|---|---|---|---|---|---|---|
| 1xLoD | +++++++ | +++++++ | +++++++ | +++++++ | +++++++ | +++++++ | +++++++ | +++++++ | +++++++ |
| (51 c/rxn) | 100% | 100% | 100% | 100% | 100% | 100% | 100% | 100% | 100% |

+ = positive in LAMP;

LoD = Limit of Detection

The Lysis Buffer

In one embodiment, the samples may be pre-treated with a lysis buffer. A lysis buffer in the present context is a buffer solution used for breaking open cell walls for use in analysing compounds inside of the cells.

Most lysis buffers contain salts (e.g. Tris-HCl or EDTA) to regulate the acidity and osmolarity of the lysate. The EDTA inhibits endonucleases, enhances the LAMP reaction in low concentration, eliminates divalent and higher ions that may appear in urine and even inhibit the LAMP reaction in high concentration.

Sometimes detergents (such as Triton X-100 or SDS) are added to break up membrane structures. Triton X-100 solubilizes proteins from the membrane resulting in lysis and changes melting behaviour of the DNA.

Lysis buffers can be used on both animal and plant tissue cells.

In one embodiment, the lysis buffer comprises an Antimicrobial Peptide (AMP). The AMP lysis the bacterial cells.

In one embodiment, the lysis buffer comprises in ranges:

0.1-5.0 μM AMP 5-50 mM EDTA 0.1-10% non-ionic surfactant

In one exemplary, the lysis buffer comprises 10 mM EDTA, 0.4% Triton X-100 and 0.1 μM AMP.

In the Examples, the inventors have used a Triton X-100, but other non-ionic surfactant that has a hydrophilic polyethylene oxide chain and an aromatic hydrocarbon lipophilic or hydrophobic group works.

Abovementioned concentrations are calculated for the diluted urine samples of the present invention. Concentration of components can be varied and balanced per sample type and dilution ratio. For instance, samples that have higher cellular material contact may need higher ratio of lysis and inhibition supressing components and thus may also need a higher dilution ratio.

The lysis buffer is kept in a separate container. One advantage of keeping the lysis buffer may in a separate container, is included in a that no measuring required. It's a preferred embodiment simply to add the full content of lysis buffer container, because the subject does not have to make any decisions that may influence the outcome of the accuracy of the test.

The lysis may be performed prior to addition of the sample to the microfluidic test device. In case of urine samples for example, the urine may be treated for e.g. 5 min with the lysis buffer before addition of the sample to the microfluidic test device.

In one embodiment, the subject may for example pee 20 ml±5 ml in a cup, which may be delivered with the microfluidic test device, and add a fixed volume of mixture of the lysis buffer. A urine sample may for example be treated for 5 min with the lysis buffer to release the DNA into the sample-lysis buffer mixture.

From this sample-lysis buffer mixture, a fixed volume for example 10 μl comprising the released DNA may be inserted in the microfluidic test device by use of a specially designed sample plug. The sample plug secure that the fixed volume is constant and do not depend on the skills of the user. The specially designed sample plug extending along an axis and having a first end with a first end surface and comprising a sample part and a handle part, the sample part comprising a first sample recess and a second sample recess formed in the first end surface for feeding a sample into a sample inlet of the microfluidic test device.

The lysis buffer comprises an antimicrobial peptide (preferably Cecropin P1) that specifically lyses gram negative bacteria (in particular Chlamydia trachomatis and Neisseria gonorrhoeae), EDTA that is important to inhibit endonucleases, and a non-ionic surfactant that is important to lyse mammalian host cells, specifically important for lysis of Chlamydia trachomatis, because it is an intracellular parasite.

Pre-treatment of urine with lysis reagents is implemented in the urine cup with around 20 ml urine. Afterwards the lysed urine sample will be transferred into the device using the sample plug. Thereby the lysis reagents will be diluted 1:10 and the LAMP reaction tolerates these applied concentration of lysis reagents.

Antimicrobial Peptides

Antimicrobial peptides (AMPs) are a unique and diverse group of molecules, which are divided into subgroups on the basis of their amino acid composition and structure. Currently, over 2500 AMPs have been described, of synthetic or natural origin, isolated from a variety of organisms in the Antimicrobial Peptide Database, on the University of Nebraska Medical Centers homepage.

The key feature for the antimicrobial peptides of the present invention is their ability to release nucleic acids from pathogens and suppress inhibitory effect caused by sample matrix. Usually such peptide will disrupt the cell membrane and thus causing lysis. This release allows better and easier detection of the presence of the bacteria or pathogen. Efficient lysis concentration for most peptides will be in the range of 5-100 μM concentration; however, the efficient lysis concentration can be smaller or larger depending on the peptide and pathogen target.

Pre-treatment of the samples with antimicrobial peptides gives increased amount of target DNA compared to normal thermal and alkaline sample preparation. Thus, the sample pre-treatment method of the present invention is well suitable with downstream amplification applications necessary for adapting the methods to POC.

The use of peptides with higher concentrations may inhibit the amplification reaction in certain extent in comparison of ideal conditions, e.g. pure water (MQ). This is a drawback of use of peptides. However, not all the peptides have an equal effect. Among current selection of peptides, Cecropin P1 has a lowest inhibitory effect and therefore it has highest potentiality for the application(s) described herein.

In urinary sample types, specifically Cecropin P1 have even enhancing effect in comparison of pure urinary sample. This effect is explained by secondary property of peptides, which is an anti-inhibitory effect. Meaning, that in additionally to lysis effect, peptides also neutralizing inhibitory substances in real samples.

The present inventors suggest not to use too high peptide concentrations, as some peptides could have an inhibiting effect on the downstream application e.g. the LAMP reaction, thus in a presently preferred embodiment, the AMP concentration is in the range of 1-100 μM antimicrobial peptides in an undiluted urine sample, such as but not limited to 1-90 μM antimicrobial peptides, 10-80 μM antimicrobial peptides, 15-50 μM antimicrobial peptides, 20-40 μM antimicrobial peptides, and/or 30-40 μM antimicrobial peptides.

Most of AMPs have membrane active properties possibly forming pore like structures to make membrane permeable (mastoporan, melittin, bombolitin, magainins) or acting through the carpet model to disrupt microorganism membranes (cecropins).

Magainins are thought to permeabilize cell membranes by forming toroidal-pores. The proposed mechanism of action of cecropins involve the initial binding of the peptide through electrostatic attraction. It is suggested that these AMPs interact with the lipid portion of the cell membrane forming ion-permeable pores.

In one embodiment, the present invention relates to AMPs having linear cationic α-helical peptides.

In another embodiment, the present invention relates to AMPs lacking cysteine.

The antimicrobial peptides used in the methods of the present invention can be natural or synthetically antimicrobial peptides.

In one embodiment, the antimicrobial peptides of the present invention is selected from the group consisting of cecropins, mastoporan, magainins, melittines, and bombolitines.

In one embodiment, the antimicrobial peptides is selected from the group consisting of mastoporan, magainins, melittines, and bombolitines.

In a presently preferred embodiment, the antimicrobial pepetides are cecropins. Although there are also other peptides that that show relevant lysis effectiveness, they also significant inhibitory effect to LAMP reaction.

Cecropins

Cecropins are small proteins of typically about 31-37 amino acid residues active against both Gram-positive and Gram-negative bacteria.

Cecropins isolated from insects other than Hyalophora cecropia (Cecropia moth) have been given various names; bactericidin, lepidopteran, sarcotoxin, etc. All of these peptides are structurally related.

Cecropin P1, an intestinal antibacterial peptide from Sus scrofa (Pig), also belongs to this family.

Cecropin family also consists Cecropin A and Cecropin B.

Cecropins possess antimicrobial activity against a wide variety of bacteria through compromising membrane permeability.

In one embodiment of the present invention, the Cecropins may be modified or being a derivate.

In one presently preferred embodiment, the AMP is a Cecropin.

The present inventors tested antimicrobial peptides cecropins (P1 and SB-37), which both resulted in significantly increased DNA levels. SB-37 gained on average 2 times increase of the target DNA. The peptide sequence of Cecropin B analogue SB-37 is MPKWKVFKKIEKVGRNIRNGIVKAGPAIAVLGEAKALG.

Cecropin P1 was most efficient of all tested treatments, gaining on average 6 times increase of the DNA available for the isothermal amplification. Thus, in a specially preferred embodiment, the Cecropin is Cecropin P1. The peptide sequence of Cecropin P1 is SWLSKTAKKLENSAKKRISEGIAIAIQGGPR.

Sample pre-treatment with other antimicrobial peptides did not give significant increase in isothermal amplification efficiency, but still show efficacy. The lack of increase in the isothermal amplification efficiency is probably due to inefficient lysis in case of melittin and bombolitin III, or inhibition of the amplification in case of Magainin group peptides (MSI-78 and MSI-594).

```
                                    SEQ ID NO # 1
MPKWKVFKKIEKVGRNIRNGIVKAGPAIAVLGEAKALG
Hyalophora cecropia
Cecropin SB37

                                    SEQ ID NO # 2
SWLSKTAKKLENSAKKRISEGIAIAIQGGPR
Ascaris suum,
Cecropin P1
```

Melittin

Melittin is the main peptide component of the honeybee venom. It shows potent hemolytic and cytolytic activities not only against mammalian cells but owns a broad spectrum of antibacterial, antifungal, antiviral, and antiprotozoal properties.

Melittin incorporates into cell membranes forming pore-like structures that lead to profound compromise of the cell permeability and following cell death.

In one embodiment, the AMP is a Melittin.

Bombolitin

Bombolitin is the most abundant component of bumblebee venom that share structure and biological properties with melittin. Bombolitins have broad range of activity against Gram-negative and Gram-positive bacteria, as well as plant pathogenic fungi, erythrocytes, mast cells and liposomes.

In one embodiment, the AMP is a Bombolitin.

Magainins

Magainins were initially isolated from the skin of the frog *Xenopus laevis*. Magainin analogues MSI-78 and MSI 594 are a very potent AMP being active against numerous bacterial strains, including those strains that are resistant to conventional antibiotics.

In one embodiment, the AMP is a Magainin.

Advantages

The microfluidic test device according to the invention is advantageous due to the optimisation in handling time for the POC user. Thus, in one embodiment, the invention relates to a microfluidic test device as described herein, wherein the amplification time of the LAMP reaction in the device is less than 1 hour.

The storage of this device is also an advantageous due to the optimisation of especially the components, thus in one embodiment, the present invention relates to a microfluidic test device as describe herein, wherein the storage time is at least 2 years from the production date at a storage temperature of 4-30° C.

Sample

One embodiment of the present invention contemplates a POC method for measuring specific DNAs by amplification using for example LAMP amplification from a subject, said method comprising collecting a sample from said subject wherein said sample comprises cells for example from a non-human organism such as bacteria or viruses.

In one embodiment, the sample is derived from the group consisting of blood, urine, pleural fluid, bronchial fluid, oral washings, lymph fluid, spinal, tissue fluid, respiratory fluid including nasal, issue biopsies, ascites, pus, cerebrospinal fluid, aspitate and follicular fluid.

In a presently preferred embodiment the sample is derived from urine.

One presently preferred aspect of the invention relates to a point-of-care device for the detection of sexually transmitted diseases like Chlamydia trachomatis and/or Neisseria gonorrhoeae in a human subject without sample purification, the method comprising the steps;

a) providing a urine sample diluted more than 50% from the human subject,
b) adding a Cecropin peptide to the urine sample, and inserting a part of the diluted urine sample into a microfluidic test device as described herein,
c) amplifying the released nucleic acids by loop-mediated isothermal amplification (LAMP) using primers targeting Chlamydia trachomatis and/or Neisseria gonorrhoeae nucleic acids using a polymerase, preferably Bsm in the reaction chamber
d) detecting a signal from the nucleic acid originating from Chlamydia trachomatis and/or Neisseria gonorrhoeae by a lateral flow strip, and
e) indicating the human subject being infected with Chlamydia trachomatis and/or Neisseria gonorrhoeae, if the signal is above a predetermined value, wherein said point-of-care method have a detection sensitivity of more than 60% compared to the Cobas®4800 CT/NG Test (Roche) in standard settings.

Dilution of Sample

The present inventors have found out that the dilution of for example a urine sample may be important to enable the specific polymerase in the amplification step to amplify the target.

For example a Bsm polymerase used in LAMP amplification in the microfluidic test device of the present invention can tolerate easily up to 20% of urine in the reaction mixture without significant effect on reaction speed and thus also on sensitivity.

Smaller amounts (5-10%) of urine even enhances the polymerase activity in comparison of pure water. This suggests that 10% of urine is absolute optimum in respect of reaction speed. Urine amount more than 15% starts to significantly to reduce polymerization reaction exponentially. Extrapolating provided data with power function $$T_R=0.0556\mu_{\%}^2-0.761\mu_{\%}+21.32$$

where $T_R$ is relative time to result and $u_{\%}$ is urine precentral amount, results that more than 50% of urine concentration will lead to more than 2 hours reaction time, which is not feasible anymore for point-of-care applications. Generally, it is expected to have less than 1 hour turnaround time for point-of-care applications/devices of the present invention.

With higher urine concentrations, the amplification reaction time should be extended otherwise loss in sensitivity may occur due to fact that exponential phase of the reaction is not yet reached or passed, and there will not be enough reaction products (amplicons) to detect.

For example, if the predetermined reaction time is 25 minutes and urine amount is 20%, then the reaction will not reach a sufficient level. This will result in no amplicons meaning that it will be misinterpreted as negative sample and through that the results will affect overall sensitivity. Thus, in a presently preferred embodiment, the amplification is provided by a polymerase capable of tolerating diluted urine, and preferably diluted more than 50%.

Thus, the present invention relates to a urine sample which has been diluted more than 50% with a buffer, such as but not limited to diluted more than 55%, diluted more than 60%, diluted more than 65%, diluted more than 70%, diluted more than 75%, diluted more than 80%, diluted more than 85%, diluted more than 90%, or diluted more than 95% prior to amplification of the target sequences.

Amplification Step

The Loop-mediated isothermal amplification (LAMP) method as described herein stands out to be a novel, highly sensitive and specific diagnostic tool because of the ease of performing and capability to diagnose a negligible amount of pathogen genetic material within an hour.

The LAMP method in a microfluidic test device of the present invention has several advantages over the widely-used PCR.

The LAMP method in a microfluidic test device of the present invention is carried out at a constant temperature (typically 55-65° C.) and does not require a thermal cycler, typically around 60° C., such as 55-65° C., or 58-63° C. In some embodiments, the temperature is 55° C., 56° C., 57° C., 58° C., 59° C., 60° C., 61° C., 62° C., 63° C., 64° C. and/or 65° C.

The LAMP method in a microfluidic test device of the present invention uses 4-6 different primers (2 inner, 2 outer and/or 2 additional loop primers) and a polymerase with a strand displacement activity to identify 6 distinct regions on the target gene sequence. This allows generating an amplification product containing of single-stranded loop regions, where primers can bind without template denaturation. The additions of loop primers significantly accelerate amplification, increasing sensitivity and reducing reaction time.

The amount of DNA product at the end of the LAMP method in a microfluidic test device of the present invention is considerably higher that than in PCR and can be simply visualized using metal ion indicators like calcein or such DNA biding dyes as SYBR green, ethidium bromide, picogreen, propidium iodide, hydroxy naphthol blue.

Depending on primer choice, not only DNA but also RNA can be amplified. Thus, even pathogen specific RNA can be targeted as well with current invention.

Polymerases

The LAMP method in a microfluidic test device of the present invention is using elevated temperature (usually between 55-65° C.) and for that, a thermophilic DNA polymerase is required. These polymerases should have a strong strand displacement activity. These polymerases are not suitable for use in PCR. Not all thermostable DNA polymerase are suitable for urinary analysis.

For urinary analysis for example, it is important to use a polymerase, which have minimum activity loss due urine matrix effect. Particularly Omi Amp, Tin and SD polymerases lose their activity entirely already on low levels of urine. Other polymerases under current study start to lose their activity significantly on urine levels 10% and more. While Bsm polymerase is most resistant to for example urine.

Small quantities of urine even enhance Bsm polymerase activity and thus this polymerase is very suitable for urinary analysis.

In a presently preferred embodiment of the present invention, the polymerase used in the LAMP is a Bsm polymerase. In the present context, a Bsm polymerase is a DNA polymerase of *Bacillus smithii*, which catalyzes 5'→3' synthesis of DNA and lacks 5'→3' and 3'→5' exonuclease activities.

In another embodiment, then the Bsm polymerase is a Bsm DNA Polymerase, Large Fragment. In the present context, a Bsm DNA Polymerase, Large Fragment is a portion of DNA polymerase of *Bacillus smithii*, which catalyzes 5'→3' synthesis of DNA and lacks 5'→3' and 3'→5' exonuclease activities. Bsm DNA Polymerase, Large Fragment has a strong strand displacement activity and is active in a wide range of temperatures from 30° C. to 63° C., with an optimum of activity at 60° C. Bsm DNA Polymerase, Large Fragment is an enzyme with high functional similarity to Bst DNA Polymerase, Large Fragment and can replace it in most applications.

GENERAL

Various exemplary embodiments and details are described above, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

As used herein, the terms "patient" and "subject" are used interchangeably to refer to a human.

Any feature and/or aspect discussed above in connections with the device according to the invention apply by analogy to the components and their distribution described herein.

The following figures and examples are provided below to illustrate the present invention. They are intended to be illustrative and are not to be construed as limiting in any way.

FIG. 1

Turning now to the figures, FIG. 1 schematically illustrates a first (top) view of an exemplary microfluidic test device. The microfluidic test device 2 comprises a body 4 and a first chamber 6 having an outlet 8 provided with a first valve 10 and holding a first buffer having a first buffer volume.

The microfluidic test device 2 comprises a primary reaction chamber 12 and a sample inlet 14 for receiving a sample and being configured for feeding a sample having a sample volume, into the medical test device 2. A first fluid path 16 connects the outlet 8 of the first chamber 6 and the sample inlet 14 and a second fluid path 18 connects the sample inlet 14 and the primary reaction chamber 12. Further, the microfluidic test device 2 comprises a primary test part 20 comprising a primary test chamber 22 with a third primary fluid path 24 connecting the primary reaction chamber 12 and the primary test part 20. A primary valve 26 is arranged in the third primary fluid path 24. The microfluidic test device 2 comprises a flow driving device 28 configured to move fluid from the primary reaction chamber 12 to the primary test part 20. The flow driving device 28 comprises a second chamber 28A having an outlet optionally provided with a second valve 28B. The outlet of the second chamber is connected to the first fluid path 16 via fourth fluid path 29.

The microfluidic test device 2 comprises a heating assembly 30 configured to heat a reaction liquid in the primary reaction chamber 12. The heating assembly 30 is connected to a power source (not shown). The power source may be one or more batteries accommodated or inserted in the microfluidic test device. The power source may be an external power source connected to the microfluidic test device via a connector (not shown).

The primary test part 20 comprises a first lateral flow strip 32 having a first end 34 connected to an outlet of the primary test chamber 22. The first lateral flow strip 32 has a length of 65 mm and a width of 3.0 mm.

FIG. 2

Figure 2:
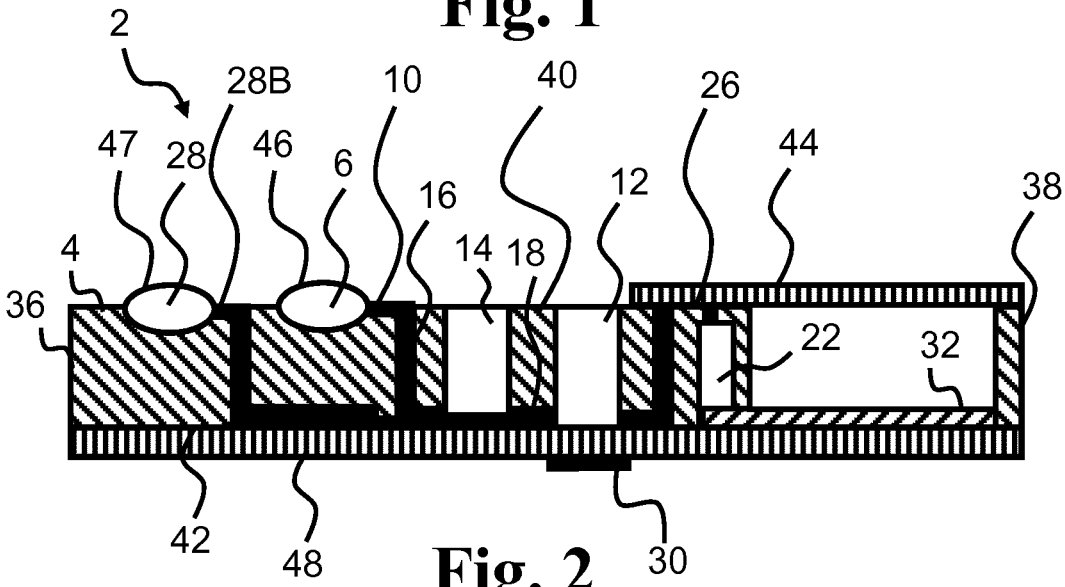
FIG. 2 shows an exemplary cross-sectional view of the microfluidic test device 2.

FIG. 2 shows an exemplary cross-sectional view of the microfluidic test device 2. The microfluidic test device 2. The body 4 has a first end 36 with a first end surface, and a second end 38 with a second end surface. The body 4 has a first surface 40 intended for facing upwards when the microfluidic test device is positioned in a test position, and a second surface 42 opposite the first surface 40 and intended for facing downwards when the microfluidic test device is positioned in a test position.

The microfluidic test device comprises a first primary foil 44 attached to the first surface 40 of the body 4. The first primary foil 44 forms a part of the third primary fluid path 24 and the primary valve 26.

The microfluidic test device comprises a first secondary foil 46 attached to the first surface 40 of the body 4. The first secondary foil 46 forms a part of the first chamber 6 and the first valve 10.

The microfluidic test device comprises a first tertiary foil 47 attached to the first surface 40 of the body 4. The first tertiary foil 47 forms a part of the flow driving device 28. The flow driving device 28 is embodied as a second chamber with an outlet and a second valve arranged at the outlet of the second chamber. The microfluidic test device comprises a second primary foil 48 attached to the second surface 42 of the body 4.

The first fluid path 16 connects the first chamber 6 and the bottom of sample inlet 14. The second fluid path 18 connects the sample inlet 14 and the first reaction chamber 12. Thus, first buffer can be moved from the first chamber 6 through the first fluid path 16 into the sample inlet 14 by pressing on the first secondary foil 46 with a force sufficient to open the first valve 10, i.e. a force to apply a first pressure larger than the first pressure threshold. The first buffer thus flushes sample in the sample inlet 14 through the second fluid path 18 and into the first reaction chamber 12, where the first buffer, the sample and a primary reaction material are mixed. After a reaction, assisted by heating with heating assembly 30, has taken place, the flow driving device 28 is activated by pressing on the first tertiary foil 47 with a force sufficient to open the second valve 28B, i.e. a force to apply a second pressure larger than the second pressure threshold. Thereby, primary reaction liquid in the primary reaction chamber 12 is moved into the primary test chamber 22 via the third primary fluid path 24 by the primary valve 26 opening upon activation of the flow driving device 28. The primary test liquid in the primary test chamber 22 flows into the first lateral flow strip 32 for obtaining a readout of the test result.

FIG. 3

Figure 3:
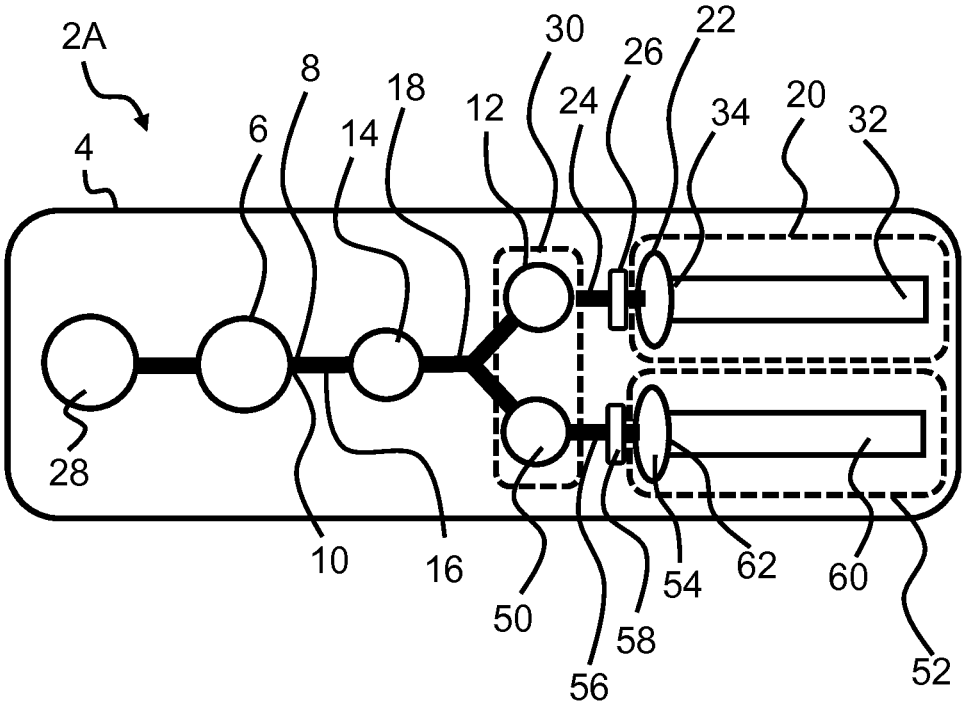
FIG. 3 schematically illustrates a first (top) view of an exemplary microfluidic test device.

FIG. 3 schematically illustrates a first (top) view of an exemplary microfluidic test device. The microfluidic test device 2A comprises a body 4 and a first chamber 6 having an outlet 8 provided with a first valve 10 and holding a first buffer having a first buffer volume.

The microfluidic test device 2 comprises a primary reaction chamber 12 and a sample inlet 14 for receiving a sample and being configured for feeding a sample having a sample volume, into the medical test device 2. A first fluid path 16 connects the outlet 8 of the first chamber 6 and the sample inlet 14 and a second fluid path 18 connects the sample inlet 14 and the primary reaction chamber 12. Further, the microfluidic test device 2 comprises a primary test part 20 comprising a primary test chamber 22 with a third primary fluid path 24 connecting the primary reaction chamber 12 and the primary test part 20. A primary valve 26 is arranged in the third primary fluid path 24. The microfluidic test device 2 comprises a flow driving device 28 configured to move fluid from the primary reaction chamber 12 to the primary test part 20, and a heating assembly 30 configured to heat a reaction fluid in the primary reaction chamber 12. The primary test part 20 comprises a first lateral flow strip 32 having a first end 34 connected to an outlet of the primary test chamber 22.

Further, the microfluidic test device 2A comprises a secondary reaction chamber 50, wherein the second fluid path 18 connects the sample inlet 14 and the secondary reaction chamber 50. Further, the microfluidic test device 2A comprises a secondary test part 52 comprising a secondary test chamber 54 with a third secondary fluid path 56 connecting the secondary reaction chamber 50 and the secondary test part 52. A secondary valve 58 is arranged in the third secondary fluid path 56. The flow driving device 28 is configured to move fluid from the secondary reaction chamber 50 to the secondary test part 52, and the heating assembly 30 is optionally configured to heat a reaction fluid in the secondary reaction chamber 50. The secondary test part 52 comprises a second lateral flow strip 60 having a first end 62 connected to an outlet of the secondary test chamber 54. The second lateral flow strip 60 has a length of 65 mm and a width of 3.0 mm.

FIGS. 4-10 show different views of exemplary microfluidic test system(s) and parts thereof. The microfluidic test system comprises a microfluidic test device (housing not shown) and a sample plug.

FIGS. 4-5

Figure 4:
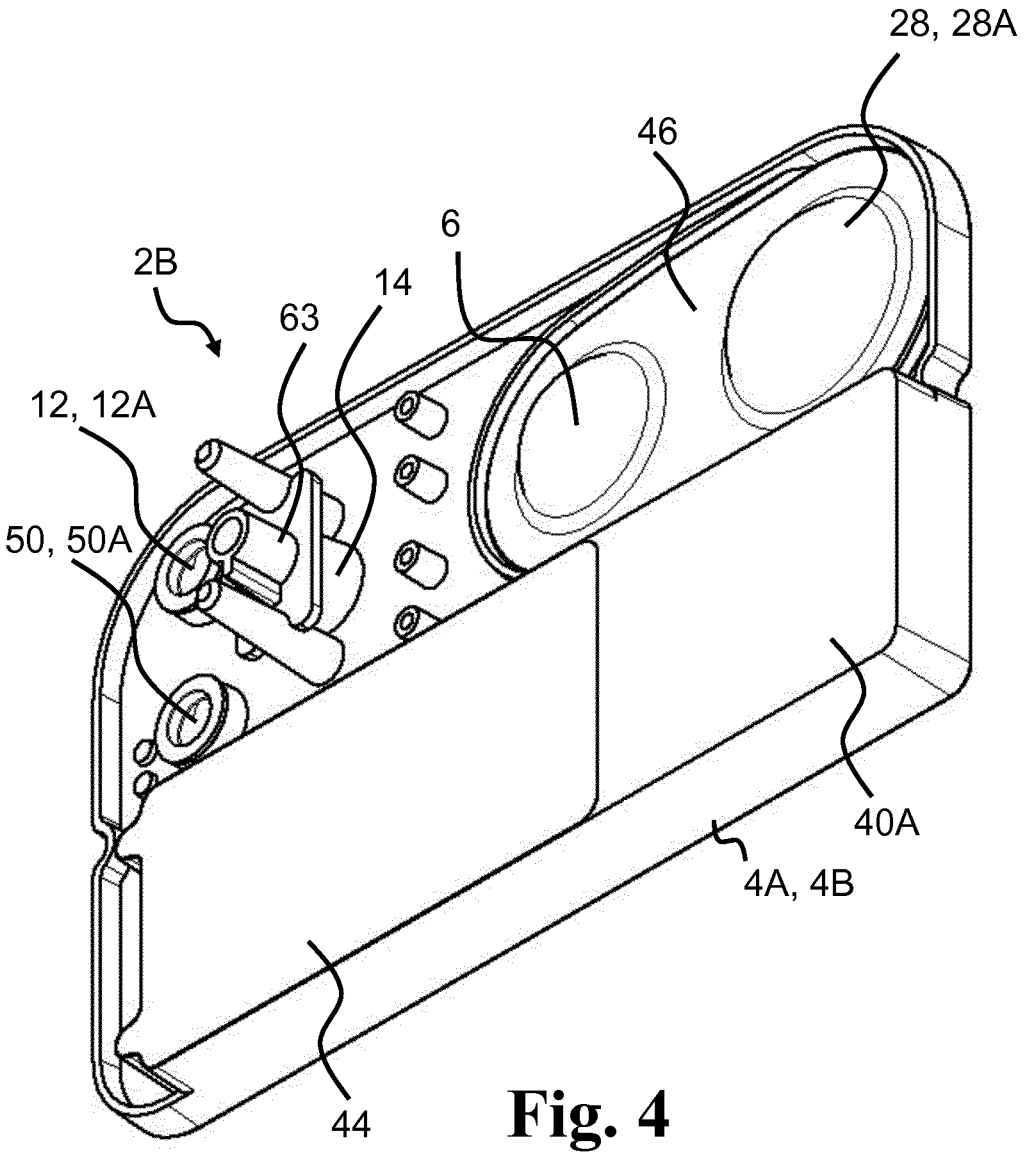
FIG. 4 shows a perspective view of parts of microfluidic test device 2B with a sample plug 63 inserted in the sample inlet of the microfluidic test device.
Figure 5:
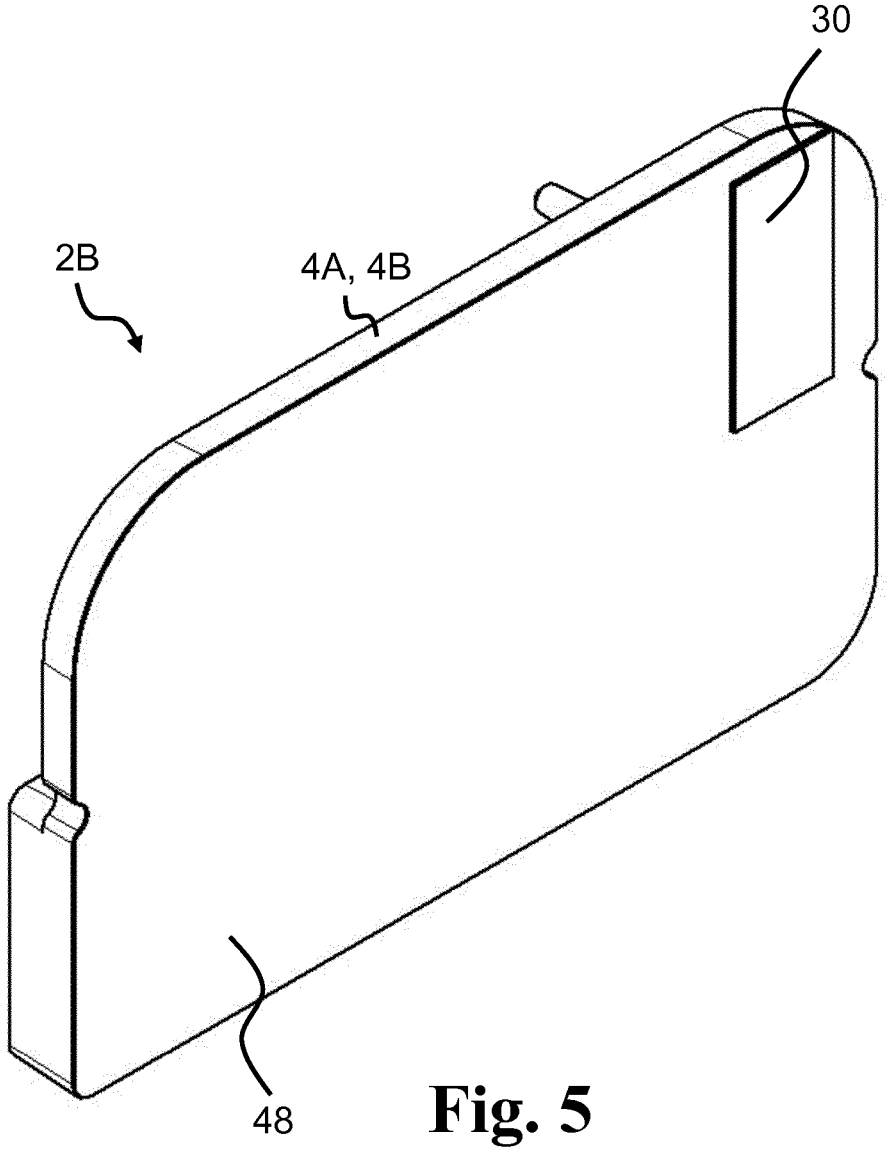
FIG. 5 shows a perspective view of parts of microfluidic test device 2B with a sample plug 63 inserted in the sample inlet of the microfluidic test device.

FIGS. 4 and 5 show perspective views of parts of microfluidic test device 2B with a sample plug 63 inserted in the sample inlet of the microfluidic test device. The microfluidic test device 2B comprises a body 4A and one or more foils attached to surfaces of the body. The microfluidic test device 2B comprises a first primary foil 44 attached to a first primary surface 40A of the body 4A and forming a part of the third fluid paths (primary and secondary), the primary valve, and the secondary valve of the microfluidic test device 2B. The first primary foil 44 optionally is a flexible plastic foil made of polypropylene that has been laserwelded to the body 4A made of polypropylene. The microfluidic test device 2B comprises a first secondary foil 46 attached to a first secondary surface 40B (See FIG. 6) of the body 4A and forming a part of the first chamber 6, first valve 10, second chamber 28A, and second valve 28B. The first secondary foil 46 optionally is a metal foil, such as an aluminium foil, and/or comprises one or more metal layers.

The first surfaces 40A, 40B are intended for facing upwards when the microfluidic test device 2B is positioned in a test position, and the second surface 42 is intended for facing downwards when the microfluidic test device 2B is positioned in a test position. The microfluidic test device 2B comprises a second primary foil 48 attached to the second surface 42 (See FIG. 7) of the body 4A. Further, the microfluidic test device 2B comprises a heating assembly 30 comprising a primary heating element. The heating element is arranged on the second primary foil 48 adjacent the primary reaction chamber and the secondary reaction chamber and configured to heat the primary reaction chamber (and primary reaction liquid) and the secondary reaction chamber (and secondary reaction liquid). The second primary foil 48 forms a part of the first, second, third (primary and secondary), and fourth fluid paths, primary reaction chamber, secondary reaction chamber, primary test chamber, secondary test chamber, and sample inlet (sample chamber).

The microfluidic test device 2B comprises a primary reaction chamber 12 and a sample inlet 14 for receiving a sample and being configured for feeding a sample having a sample volume, into the medical test device 2B. The microfluidic test device 2B comprises a primary reaction chamber plug 12A forming a part of the primary reaction chamber 12. The sample inlet 14 is configured for receiving the sample plug 63, the sample plug 63 carrying the sample. A first fluid path connects the outlet of the first chamber 6 and the sample inlet 14 and a second fluid path connects the sample inlet 14 and the primary reaction chamber 12. Further, the microfluidic test device 2B comprises a primary test part comprising a primary test chamber and a first lateral flow strip with a third primary fluid path connecting the primary reaction chamber 12 and the primary test part (primary test chamber). A primary valve is arranged in the third primary fluid path. The microfluidic test device 2B comprises a flow driving device 28 configured to move fluid from the primary reaction chamber 12 to the primary test part. The flow driving device 28 comprises a second chamber 28A having an outlet optionally provided with a second valve. The outlet of the second chamber is connected to the first fluid path via fourth fluid path.

Further, the microfluidic test device 2B comprises a secondary reaction chamber 50, wherein the second fluid path connects the sample inlet 14 and the secondary reaction chamber 50. The microfluidic test device 2B comprises a secondary reaction chamber plug 50A forming a part of the secondary reaction chamber 50. Further, the microfluidic test device 2B comprises a secondary test part comprising a secondary test chamber and a second lateral flow strip, with a third secondary fluid path connecting the secondary reaction chamber 50 and the secondary test part (secondary test chamber). A secondary valve is arranged in the third secondary fluid path. The flow driving device 28 is configured to move fluid from the secondary reaction chamber 50 to the secondary test part.

FIG. 6

Figure 6:
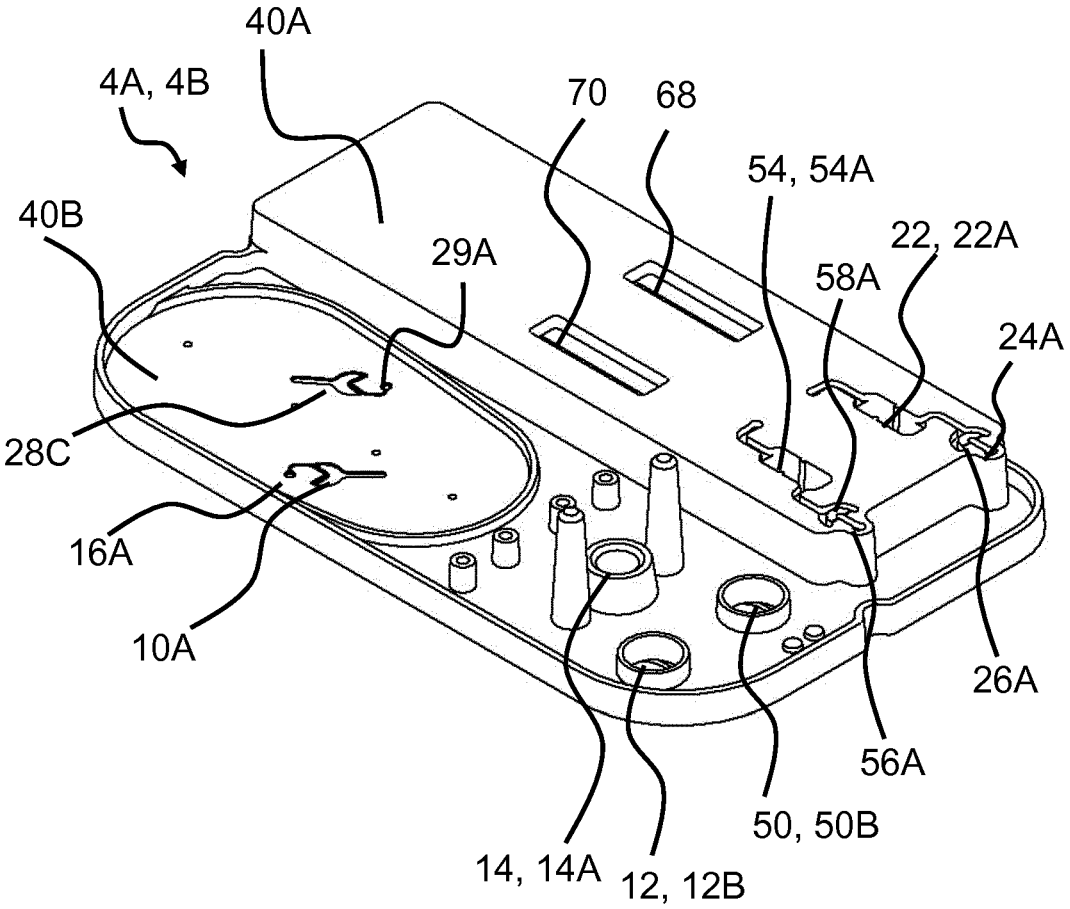
FIG. 6 shows a perspective view of a body of the microfluidic test device.

FIG. 6 shows a perspective view of a body of the microfluidic test device.

A first valve body part 10A of the body 4A forms a part of the first valve 10. The first valve body part 10A is formed as a recess in the first secondary surface 40B of the body 4A. A first through-going bore 16A from the first secondary surface 40B to the second surface 42 forms a part of the first fluid path 18.

A primary reaction chamber body part 12B forms a part of the primary reaction chamber 12. The primary reaction chamber body part 12B is formed as a through-going bore in the body with the primary reaction chamber plug 12A and the second primary foil 48 forming top and bottom of the primary reaction chamber 12.

A primary test chamber body part 22A of the body 4A forms a part of the primary test chamber 22. The primary test chamber body part 22A is formed as a through-going bore from the first primary surface 40A to the second surface 42. The first primary foil 44 and the second primary foil 48 form top and bottom of the primary test chamber 22.

A primary valve body part 26A of the body 4A forms a part of the primary valve 26. The primary valve body part 26A is formed as a recess in the first primary surface 40A of the body 4A. A primary through-going bore 24A from the first primary surface 40A to the second surface 42 forms a part of the third primary fluid path 24.

A second valve body part 28C of the body 4A forms a part of the second valve 28B. The second valve body part 28C is formed as a recess in the first secondary surface 40B of the body 4A. A fourth through-going bore 29A from the first secondary surface 40B to the second surface 42 forms a part of the fourth fluid path 29.

A secondary reaction chamber body part 50B forms a part of the secondary reaction chamber 50. The secondary reaction chamber body part 50B is formed as a through-going bore in the body with the secondary reaction chamber plug 50A and the second primary foil 48 forming top and bottom of the secondary reaction chamber 50.

A secondary test chamber body part 54A of the body 4A forms a part of the secondary test chamber 54. The secondary test chamber body part 54A is formed as a through-going bore from the first primary surface 40A to the second surface 42. The first primary foil 44 and the second primary foil 48 form top and bottom of the secondary test chamber 54.

A secondary valve body part 58A of the body 4A forms a part of the secondary valve 58. The secondary valve body part 58A is formed as a recess in the first primary surface 40A of the body 4A. A secondary through-going bore 56A from the first primary surface 40A to the second surface 42 forms a part of the third secondary fluid path 56.

The microfluidic test device comprises a first flow strip chamber and a second flow strip chamber partly formed in the body 4A. The first flow strip chamber is accessible through a first opening 68 in the first primary surface 40A, and the second flow strip chamber is accessible through a second opening 70 in the first primary surface 40A. The first and second openings enables optical readout of lateral flow strips.

FIG. 7

Figure 7:
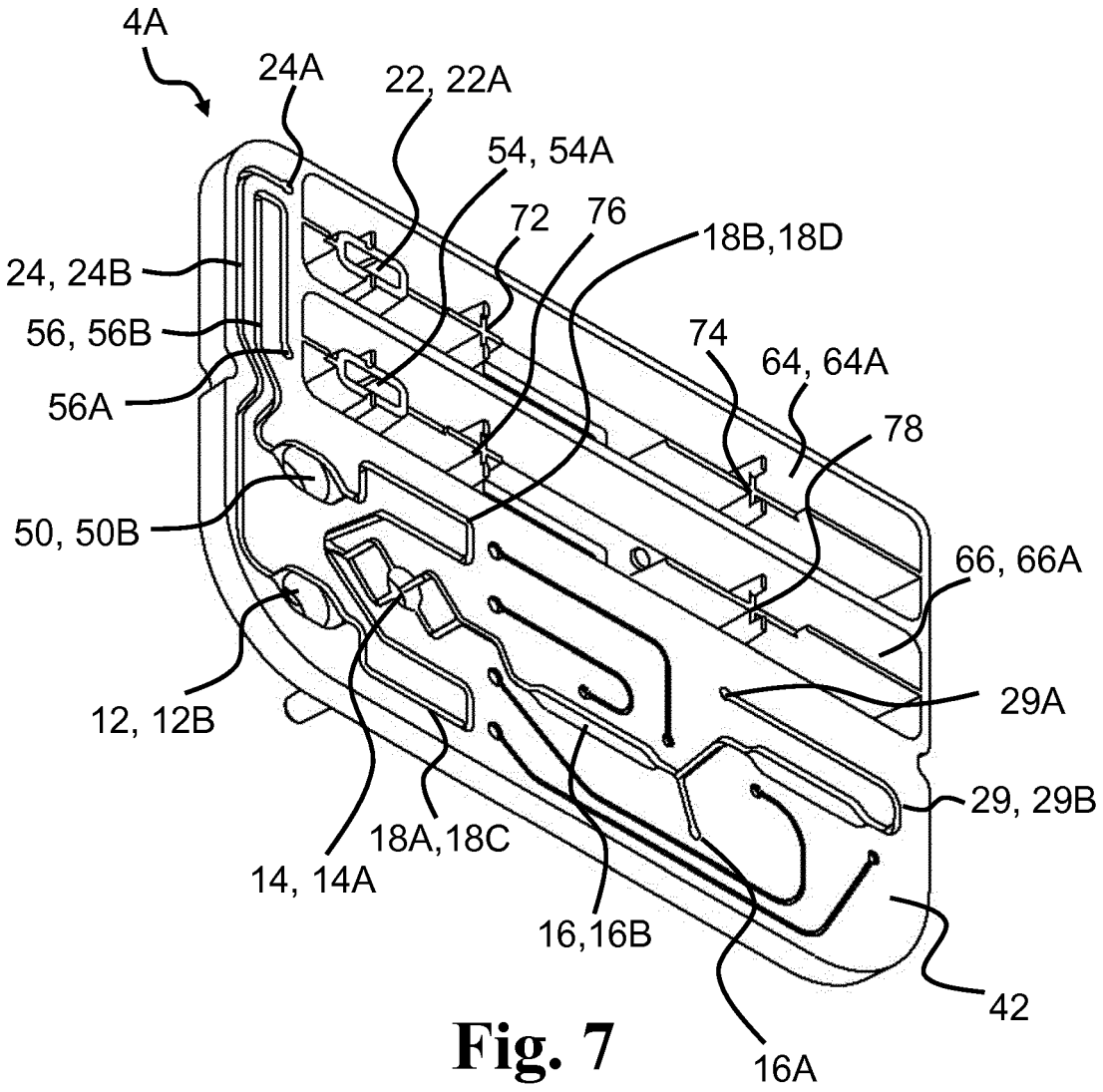
FIG. 7 shows another perspective view of the body 4A, where a first recess 16B forms a part of the first fluid path 16 between the first chamber 6 and the sample inlet 14 partly formed by sample inlet body part 14A.

FIG. 7 shows another perspective view of the body 4A, where a first recess 16B forms a part of the first fluid path 16 between the first chamber 6 and the sample inlet 14 partly formed by sample inlet body part 14A. The second fluid path comprises a second primary fluid path 18A and a second secondary fluid path 18B. The second primary fluid path 18A connects the sample inlet 14 and the primary reaction chamber 12, and the second secondary fluid path 18B connects the sample inlet 14 and the secondary reaction chamber 50. A second primary recess 18C in the second surface 42 forms, together with the second primary foil 48, a part of the second primary fluid path 18A. A second secondary recess 18D in the second surface 42 forms, together with the second primary foil 48, a part of the second secondary fluid path 18B.

A fourth recess 29B in the second surface 42 forms, together with the second primary foil 48, a part of the fourth fluid path 29. The fourth fluid path 29 connects the outlet of the second chamber 28A at second valve 28B and the first fluid path 16.

A third primary recess 24B in the second surface 42 forms, together with the second primary foil 48, a part of the third primary fluid path 24.

A third secondary recess 56B in the second surface 42 forms, together with the second primary foil 48, a part of the third secondary fluid path 56.

A first strip chamber recess 64A forms a part of first flow strip chamber for accommodating a first lateral flow strip. A second strip chamber recess 66A forms a part of second flow strip chamber 66 for accommodating a second lateral flow strip. The second primary foil 48 forms the bottom of the flow strip chambers 64, 66. A first end of the first lateral flow strip is arranged to overlap with the primary test chamber body part 22A such that test liquid in the primary test chamber 22 is fed to the first lateral flow strip. A first end of the second lateral flow strip is arranged to overlap with the secondary test chamber body part 54A such that test liquid in the secondary test chamber 54 is fed to the second lateral flow strip.

First holding elements 72, 74 are provided in the first flow strip chamber 64 of the body 4A. The first primary holding element 72 and the first secondary holding element 74 are configured to hold or fixate the first lateral flow strip in position between the body 4A and the second primary foil 48. Second holding elements 76, 78 are provided in the second flow strip chamber 66 of the body 4A. The second primary holding element 76 and the second secondary holding element 78 are configured to hold or fixate the second lateral flow strip in position between the body 4A and the second primary foil 48.

FIG. 8

Figure 8:
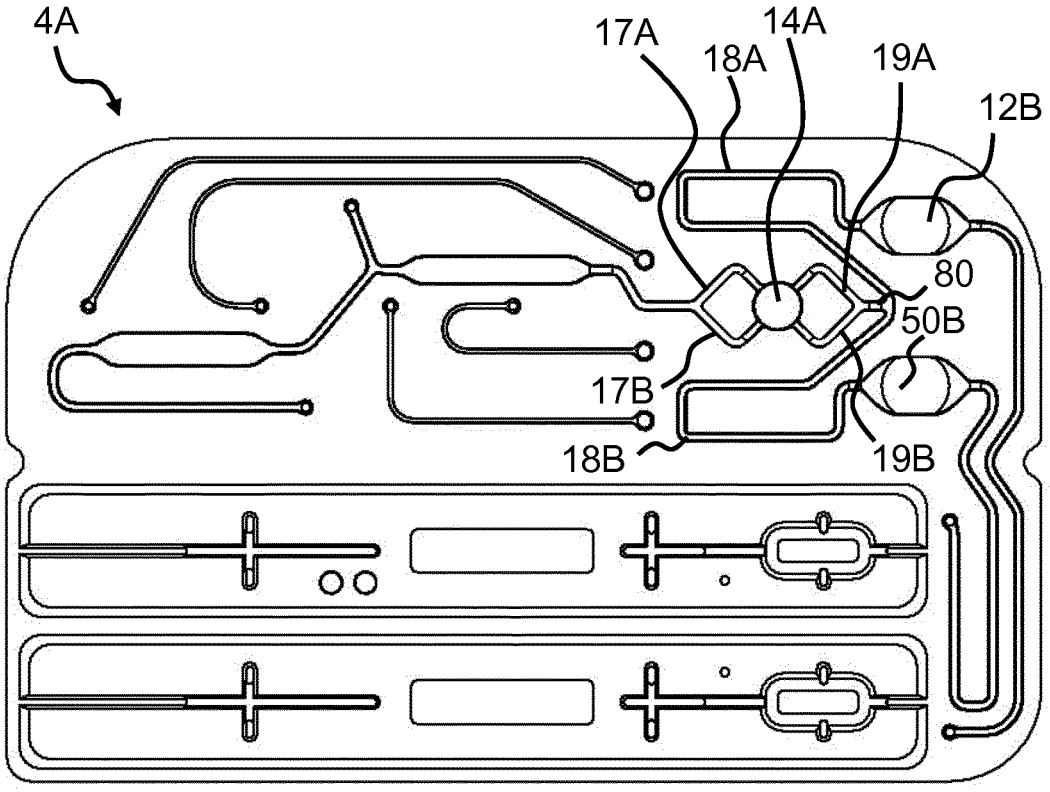
FIG. 8 shows a second or bottom view of the body 4A.

FIG. 8 shows a second or bottom view of the body 4A. The first fluid path 16 comprises and is split into a first branch formed by first branch recess 17A and second primary foil 48 and a second branch formed by second branch recess 17B and second primary foil 48. The first branch of the first fluid path feeds first buffer into a first inlet of the sample chamber formed by sample inlet and sample plug. The second branch of the second fluid path feeds first buffer into a second inlet of the sample chamber formed by sample inlet and sample plug. A plurality of sample chamber inlets in the microfluidic test device provides improved flushing of the sample. In one or more exemplary, the sample chamber only has a single inlet.

The second fluid path 18 comprises a first branch formed by first branch recess 19A and second primary foil 48 and a second branch formed by second branch recess 19B and second primary foil 48. Liquid from the sample chamber enters the first branch and the second branch of the second fluid path via respective first outlet and second outlet of the sample chamber. The first branch and the second branch of the second fluid path are joined in second fluid path joint 80 before splitting into second primary fluid path 18A and second secondary fluid path 18B.

FIG. 9

Figure 9:
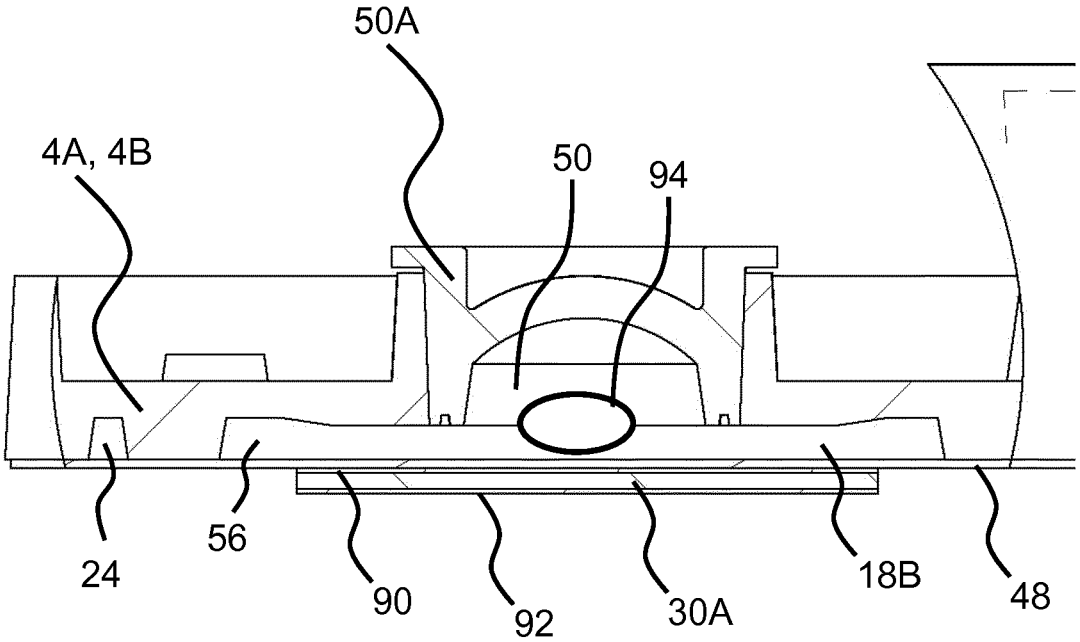
FIG. 9 shows a cut out side view of the microfluidic test device 4A illustrating the heating assembly in further detail.

FIG. 9 shows a cut out side view of the microfluidic test device 4A illustrating the heating assembly in further detail. The heating assembly 30 comprises a primary heating element 30A sandwiched between a first electrode layer 90 and a second electrode layer 92 for applying a primary voltage to the primary heating element. The heating assembly 30 (first electrode layer 90) is attached to the second primary foil 48 adjacent to and overlapping the primary and secondary reaction chambers 12, 50. A primary pellet of primary reaction material (not shown) is arranged in the primary reaction chamber, and a secondary pellet 94 of secondary reaction material is arranged in the secondary reaction chamber 50. The thin second primary foil 48 provides a good heat transport to reaction liquid in the reaction chambers 12, 50. Thus, low heat loss from the heating assembly to the reaction chambers and precise control of the reaction liquid temperature is provided.

Figure 10:
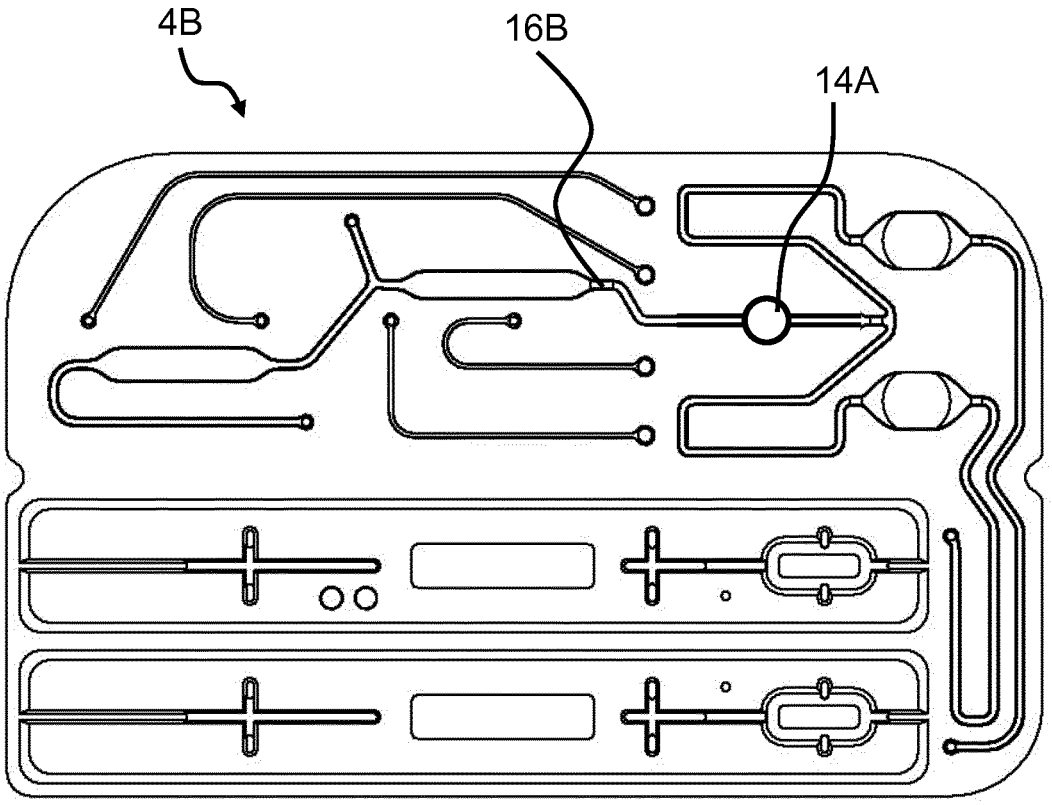
FIG. 10 shows an exemplary body 4B of a microfluidic test device.

FIG. 10 FIG. 10 shows an exemplary body 4B of a microfluidic test device. The sample chamber/sample inlet 14A has a single inlet from the first fluid path. Further, the sample chamber/sample inlet 14A has a single outlet to the second fluid path. In one or more exemplary microfluidic test devices, a single inlet from the first fluid path may be combined with two or more outlets to the second fluid path. Further, two or more inlets from the first fluid path may be combined with a single outlet to the second fluid path.

The use of the terms "first", "second", "third", "fourth", "primary", "secondary", etc. does not imply any particular order, but are included to identify individual elements. Moreover, the use of the terms "first", "second", "third", "fourth", "primary", "secondary", etc. does not denote any order or importance, but rather these terms are used to distinguish one element from another. Note that the words "first", "second", "third", "fourth", "primary", and "secondary", are used here and elsewhere for labelling purposes only and are not intended to denote any specific spatial or temporal ordering. Furthermore, the labelling of a first element does not imply the presence of a second element and vice versa.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

FIG. 11

Comparing the amplification time of pellet 1 and pellet 2 with the liquid LAMP-Assay as a reference, only pellet 2 performed similar to the reference. qLAMP Amplification time of reactions including different excipients compared to H2O control without excipient.

FIG. 12

LAMP results of reactions including different excipients compared to H2O control without excipient.

FIG. 13 qLAMP results testing different reaction buffer components lyophilized in the pellet.

- Pellet 1 (RD_4138) (RED) included the original 10× reaction buffer ([(NH4)2SO4] and was resuspended in Resuspension buffer (RD_4224) including betaine, MgSO4 and water.
- Pellet 2 (RD_4159) (GREEN) included 10× reaction buffer without (NH4)2SO4 and was resuspended in Resuspension buffer (RD_4225) including betaine, MgSO4, (NH4)2SO4 and water
- Pellet 3 (RD_4158) (PINK) included 10× reactionBuffer with NH4(CH3COO) instead of (NH4)2SO4] and was resuspended in Resuspension buffer (RD_4224) including betaine, MgSO4 and water.

LIST OF REFERENCES

2, 2A, 2B microfluidic test device
4, 4A, 4B body
6 first chamber
8 outlet
10 first valve
10A first valve body part
12 primary reaction chamber
12A primary reaction chamber plug
12B primary reaction chamber body part
14 sample inlet
16 first fluid path
16A first through-going bore
16B first recess
17A first branch recess of first fluid path
17B second branch recess of first fluid path
18 second fluid path
18A second primary fluid path
18B second secondary fluid path
18C second primary recess
18D second secondary recess
19A first branch recess of second fluid path
19B second branch recess of second fluid path
20 primary test part
22 primary test chamber
22A primary test chamber body part
24 third primary fluid path
24A primary through-going bore
24B third primary recess
26 primary valve
26A primary valve body part
28 flow driving device
28A second chamber
28B second valve
28C second valve body part
29 fourth fluid path
29A fourth through-going bore
29B fourth recess
30 heating assembly
30A primary heating element
32 first lateral flow strip
34 first end of first lateral flow strip
36 first end of body
38 second end of body
40 first surface of body
40A first primary surface of body
40B first secondary surface of body
42 second surface of body
44 first primary foil
46 first secondary foil
47 first tertiary foil
48 second primary foil
50 secondary reaction chamber
50A secondary reaction chamber plug
50B secondary reaction chamber body part
52 secondary test part
54 secondary test chamber
54A secondary test chamber body part
56 third secondary fluid path
56A secondary through-going bore
56B third secondary recess
58 secondary valve
58A secondary valve body part
60 second lateral flow strip
62 first end of second lateral flow strip
63 sample plug
64 first flow strip chamber
64A first strip chamber recess
66 second flow strip chamber
66A second strip chamber recess
68 first opening
70 second opening
72 first primary holding element
74 first secondary holding element
72 first primary holding element
74 first secondary holding element
76 second primary holding element
78 second secondary holding element
80 second fluid path joint
90 first electrode
92 second electrode
94 secondary pellet of secondary reaction material.

EXAMPLES

Example 1—Stage of Components

Experiments were performed to compare the LAMP reaction with the components in two states, lyophilized as pellets and in liquid form. Liquid components were mixed together fresh from frozen individual components and used the same day (see Table 1).

Pellets were created through freeze drying while several components are left in a buffer that is used later to dissolve the pellet (see Tables 4 and 5).

TABLE 6

Results of example experiment.

| | | | | |
|---|---|---|---|---|
| pellet | 3xLOD +urin | 30 min | pos<br>pos | Negative controls: 2/2 |
| pellet | 3xLOD +urin | 30 min | pos<br>pos | neg. Positive |
| pellet | 3xLOD +urin | 30 min | pos<br>pos | controls: 2/2 pos. |

The controls were made with fresh master mix as outlined above. DNA was spiked into urine to be used as the sample material. The reaction was left for 30 minutes in the chip with pellets and 25 minutes for the controls, since the heater in the chip needs longer to heat up.

The workflow is slightly different for both cases however. With the fresh samples (control), the urine is mixed into the master mix and then incubated. All components are liquid. Whereas, in the chip, the buffer does not contain all components and some are in the pellet. Firstly, the sample is mixed with the buffer and then the rest of the components are introduced (as the pellet is dissolved).

In conclusion, even at the limit of detection both versions of the assay perform equally well. Splitting the components of the LAMP assay into two groups while lyophilizing one and keeping the other in the liquid buffer is a good option that does not impact the performance of the assay. At the same time it allows to make the components stable since they can be stored in dry form. The components that remain in the liquid buffer would impede the lyophilisation process, but remain stable in liquid form.

Example 2—Determination of Ammonium Ions Placement

The 10× reaction buffer included in LAMP assay includes 100 mM $(NH_4)_2SO_4$. However, $(NH_4)_2SO_4$ could be disadvantageous for the stability of the pellet. Therefore, we tested different pellet compositions (with and without $(NH_4)_2SO_4$) compared to our liquid LAMP Assay in a quantitative LAMP assay (qLAMP).

Besides the $(NH_4)_2SO_4$ composition of pellet 1 and 2 was the same.

Liquid qLAMP-Assay:

| MM1 | Final concentration |
|---|---|
| qLAMP primer mix | 1x |
| $MgSO_4$ (100 mM) | 6 mM |
| dNTP mix (4 × 25 mM) | 4 × 1.4 mM |
| 10x reaction Buffer | 1x |
| Betaine (5M) | 0.8M |
| EvaGreen (EG) (20x) | 0.5x |
| Bsm polymerase (8 U/μl) | 3.2 U/reaction |
| Qia-water | |
| TOTAL | |
| DNA (ATCC VR886D) | |

10× reaction Buffer: 200 mM TrisHCl (pH 8.8 at 25° C.), 100 mM KCL, 100 mM $(NH_4)_2SO_4$, 20 mM $MgSO_4$, 1% (v/v) Tween 20

Pellet 1 (RD_4138) included the original 10× reaction buffer and was resuspended in 2× Resuspension buffer (RD_4224) and water.

| MM2 for RD_4138 | Final concentration |
|---|---|
| qLAMP primer mix | 1x |
| RD_4224 (2x Resusp Buff) | 1x |
| EvaGreen (EG) (20x) | 0.5x |
| Qia-water | |
| TOTAL | |
| DNA (ATCC VR886D)/$H_2O$ | |

RD_4224: 1.6M Betaine, 12 mM $MgSO_4$

Pellet 2 (RD_4159) included 10× reaction buffer without $(NH_4)_2SO_4$ and was resuspended in 2× Resuspension buffer with $(NH_4)_2SO_4$ (RD_4225) and water.

| MM3 for RD_4159 | Final concentration |
|---|---|
| qLAMP primer mix | 1x |
| RD_4225 (2x Resusp Buff) | 1x |
| EvaGreen (EG) (20x) | 0.5x |
| Qia-water | |
| TOTAL | |
| DNA (ATCC VR886D)/$H_2O$ | |

RD_4225: 1.6M Betaine, 12 mM $MgSO_4$, 20 mM $(NH_4)_2SO_4$

The MasterMixes (MM) were prepared. MM1 was distributed in a 96-well plate. MM2 and MM3 were used to re-suspend pellet 1 or pellet 2 respectively and afterwards this mixture was transferred into a 96-well plate. Genomic DNA was added in an appropriate concentration and qLAMP was performed in a CFX96 Touch™ and analysed with the BioRad CFX Manager Software.

Figure 11:
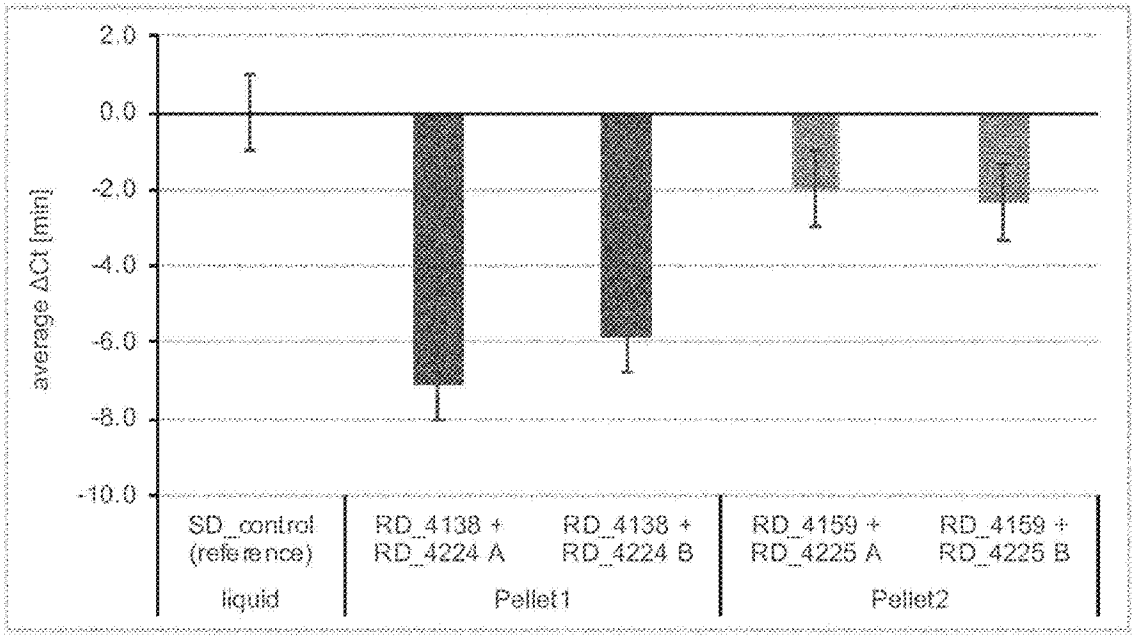
FIG. 11 shows data related to qLAMP Amplification time of reactions including different excipients compared to H2O control without excipient.
Figure 12:
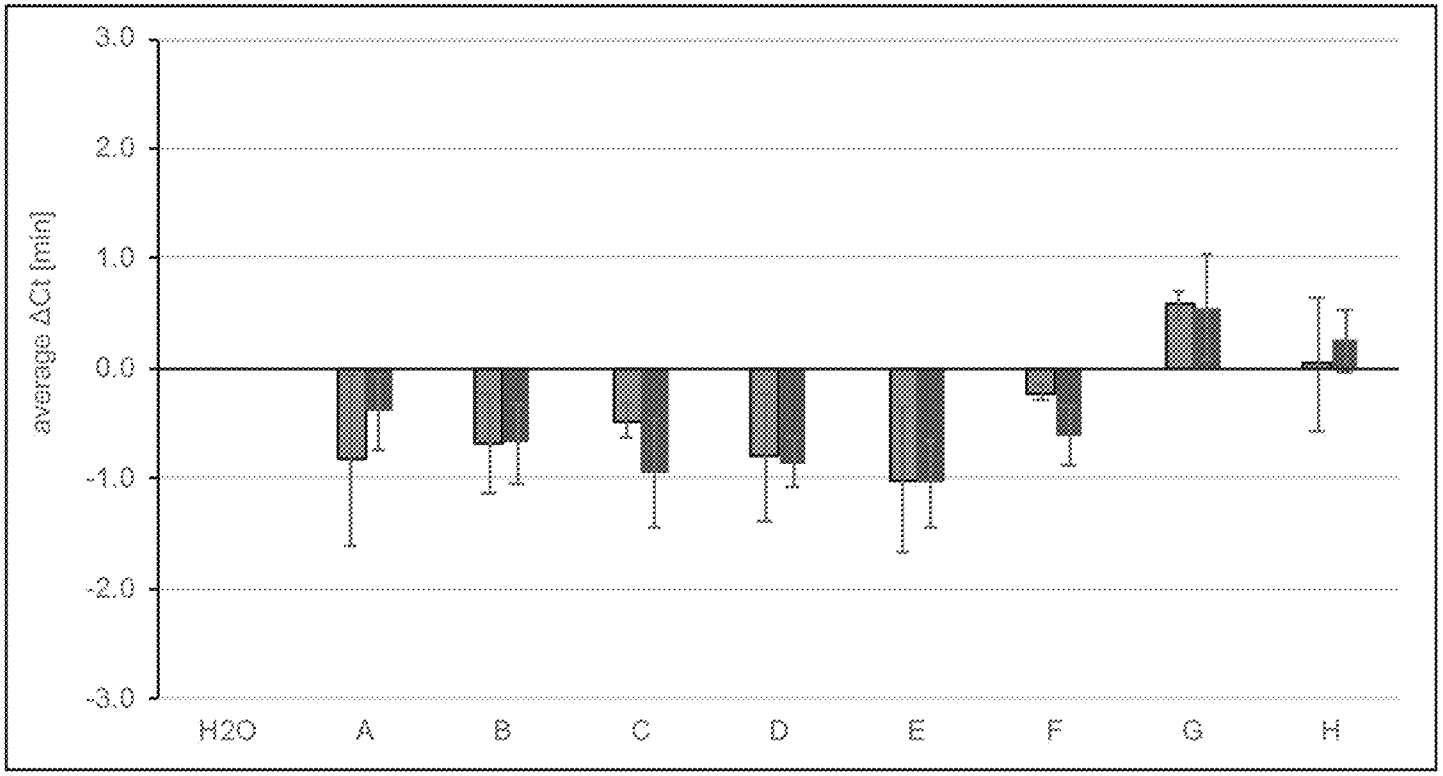
FIG. 12 shows data related to LAMP results of reactions including different excipients compared to H2O control without excipient.

Comparing the amplification time of pellet 1 and pellet 2 with the liquid LAMP-Assay as a reference where all the components are the same and in the same concentration but only in liquid form, only pellet 2 performed similar to the reference. With pellet 1 amplification was delayed 6 to 7 min compared to the reference assay. Pellet 2 showed a delay of only 2 min compared to a standard liquid LAMP Assay, which is in the range of our acceptance criteria (3 min)—see FIG. 11.

Therefore, we concluded that the removal of $(NH_4)_2SO_4$ from the pellet supports the lyophilisation process and the stability of the pellets. Consequently, $(NH_4)_2SO_4$ is included in the First Buffer.

Example 3—Freeze Drying Process of Components

All components that need to be included in the pellet for freeze drying are prepared by taking them out of storage (and thawing them). Most can now be mixed together directly, however Glycerol is interfering with the freeze drying process and is removed via filter columns from the polymerase prior to mixing. Then the mixed components are frozen solid by placing them in a −80 freezer for 30 minutes. Now the frozen components are placed in a lyophilisation machine and the water is removed under low pressure and low temperature. After 24 hours the samples are removed from the lyophilisation machine and used or placed in a dry environment for storage (for example an evacuated aluminium pouch).

Example 4—Lysis of the Bacterial Cells

Urine samples 20 ml±5 ml were collected and treated for 5 min with 1±0.1 ml 21× lysis buffer to achieve a final concentration of lysis buffer in urine of 10 mM EDTA, 0.4% Triton X-100 and 0.1 μM AMP.

10 μl of the urine lysis buffer mixture including the released DNA was inserted in the device by a specially designed sample plug, said sample plug extending along an axis and having a first end with a first end surface and comprising a sample part and a handle part, the sample part comprising a first sample recess and a second sample recess formed in the first end surface for feeding a sample into a sample inlet of the microfluidic test device.

Example 5—(NH4)2SO4 Placement (NH4)2SO4 was removed from the reaction buffer and put it into the blister buffer or displace it with NH4 (CH3COO) in the reaction buffer, since it can have some disadvantages on lyophilisation process and the stability of the pellets.

Different pellets produced were tested in our qLAMP reaction (FIG. 3). For better understanding the following reaction was developed (Tab. 1):

TABLE 1

LAMP reagents included in liquid reaction

| LAMP-reagents | Stock conc. (to be prepared) | End concentration in LAMP (50 ul) |
|---|---|---|
| Water | | |
| Primer-Mix | 100 μM | 5.2 uM |
| MgSO4 | 1M | 6 mM |
| dNTPs | 4 × 25 mM | 4 × 1.4 mM |
| reaction Buffer* | 10x | 1x |
| Betaine | 5M | 0.8M |
| Polymerase (Bsm) | 1600 U (8 U/μl) | 16 U |

TABLE 1-continued

| LAMP reagents included in liquid reaction | | |
|---|---|---|
| LAMP-reagents | Stock conc. (to be prepared) | End concentration in LAMP (50 ul) |

*10x reaction buffer: 200 mM TrisHCl (pH 8.8 at 25° C.), 100 mM KCL, 100 mM (NH4)2SO4, 20 mM MgSO4, 1% (v/v) Tween 20

We decided to exclude betaine from the reaction buffer and to clean up Bsm (glycerol-free; +5%) and additionally to exclude the 6 mM MgSO4 from the pellet (see 2a+b). Therefore, at this point the reaction was split into pellet and blister buffer according to table 2+3.

TABLE 2

| LAMP reagents included in pellet | |
|---|---|
| Pellet reagents | End concentration (50 ul) |
| Primer-Mix | 5.2 uM |
| dNTPs | 4 × 1.4 mM |
| 10x reactionBuffer* | 1x |
| Polymerase (Bsm) | 16.8 U |

*10x reaction buffer: 200 mM TrisHCl (pH 8.8 at 25° C.), 100 mM KCL, 100 mM (NH4)2SO4, 20 mM MgSO4, 1% (v/v) Tween 20

TABLE 3

| LAMP reagents included in the first buffer | | |
|---|---|---|
| 1.1x BlisterBuffer-reagents | stock concentration | End concentration (50 ul) |
| Water | | |
| MgSO4 | 6.67 mM | 6 mM |
| Betaine | 0.89M | 0.8M |

For testing the (NH4)2SO4 issue we now used the quantitative LAMP assay (qLAMP), which additionally includes EvaGreen and tested different pellet compositions (with and without (NH4)2SO4 or with NH4(CH3COO)) compared to our liquid LAMP Assay in.

Figure 13:
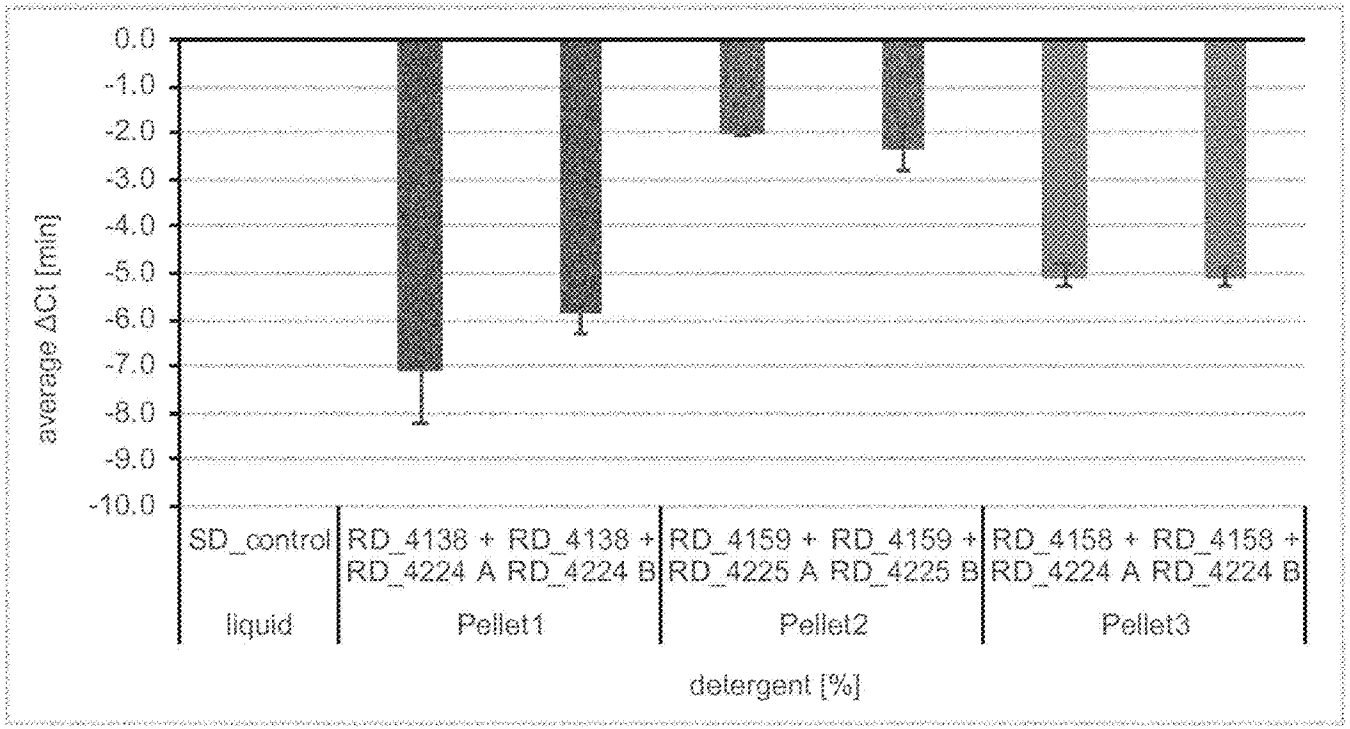
FIG. 13 shows data related to qLAMP results testing different reaction buffer components lyophilized in the pellet.

Besides the (NH4)2SO4 composition pellet 1, 2 and 3 included the same substances—see FIG. 13. Comparing the amplification time of pellet 1, 2 and 3 with the liquid LAMP-Assay as a reference, only pellet 2 performed similar to the reference. With pellet 1+3 amplification was delayed 5 to 7 min compared to the reference assay. Pellet 2 showed a delay of only 2 min compared to SelfD reference, which is in the range of our acceptance criteria (3 min).

Pellet 1 (RD_4138) (RED) included the original 10× reaction buffer ([(NH4)2SO4] and was resuspended in Resuspension buffer (RD_4224) including betaine, MgSO4 and water.

Pellet 2 (RD_4159) (GREEN) included 10× reaction buffer without (NH4)2SO4 and was resuspended in Resuspension buffer (RD_4225) including betaine, MgSO4, (NH4)2SO4 and water Pellet 3 (RD_4158) (PINK) included 10× reactionBuffer with NH4(CH3COO) instead of (NH4)2SO4] and was resuspended in Resuspension buffer (RD_4224) including betaine, MgSO4 and water.

Therefore, we concluded that the removal of (NH4)2SO4 from the pellet supports the lyophilisation process and the stability of the pellets in the device. NH4(CH3COO) did not compensate the delay. Consequently (NH4)2SO4 is included in the BlisterBuffer.

Additionally, we added ProClin950 a biozide to the BlisterBuffer in order to inhibit microbial growth. ProClin950 did not inhibit the LAMP reaction and may be beneficial for long term storage of BlisterBuffer at RT.

The optimal distribution of reagents in pellet and BlisterBuffer is:

TABLE 4

| LAMP reagents included in pellet | |
|---|---|
| Pellet reagents | End concentration (50 ul) |
| Primer-Mix | 5.2 uM |
| dNTPs | 4 × 1.4 mM |
| 10x reactionBuffer* | 1x |
| Polymerase (Bsm) | 16.8 U |

*10x reaction buffer: 200 mM TrisHCl (pH 8.8 at 25° C.), 100 mM KCL, 20 mM MgSO4, 1% (v/v) Tween 20

TABLE 6

| LAMP reagents included in BlisterBuffer | | |
|---|---|---|
| 1.1x BlisterBuffer-reagents | stock concentration | End concentration (50 ul) |
| Water | | |
| MgSO4 | 6.67 mM | 6 mM |
| Betaine | 0.89M | 0.8M |
| (NH4)2SO4 | 11.1 mM | 10 mM |
| ProClin | 0.1% | 0.09% |

SEQUENCE LISTING

```
<160> NUMBER OF SEQ ID NOS: 2

<210> SEQ ID NO 1
<211> LENGTH: 38
<212> TYPE: PRT
<213> ORGANISM: Hyalophora cecropia
<220> FEATURE:
<223> OTHER INFORMATION: Cecropin SB37

<400> SEQUENCE: 1

Met Pro Lys Trp Lys Val Phe Lys Lys Ile Glu Lys Val Gly Arg Asn
1               5                   10                  15

Ile Arg Asn Gly Ile Val Lys Ala Gly Pro Ala Ile Ala Val Leu Gly
            20                  25                  30
```

-continued

```
Glu Ala Lys Ala Leu Gly
        35


<210> SEQ ID NO 2
<211> LENGTH: 31
<212> TYPE: PRT
<213> ORGANISM: Ascaris suum
<220> FEATURE:
<223> OTHER INFORMATION: Cecropin P1

<400> SEQUENCE: 2

Ser Trp Leu Ser Lys Thr Ala Lys Lys Leu Glu Asn Ser Ala Lys Lys
1               5                   10                  15

Arg Ile Ser Glu Gly Ile Ala Ile Ala Ile Gln Gly Gly Pro Arg
            20                  25                  30
```

What is claimed is:

1. A microfluidic test device comprising: a body;

a first chamber having an outlet provided with a first valve and configured to hold a first buffer having a first buffer volume; a primary reaction chamber;

a sample inlet for receiving a sample and being configured for feeding a sample having a sample volume, into the device;

a first fluid path in fluid communication with the outlet of the first chamber and the sample inlet;

a second fluid path in fluid communication with the sample inlet and the primary reaction chamber;

a primary test part comprising a primary test chamber;

a third primary fluid path in fluid communication with the primary reaction chamber and the primary test part;

a primary valve arranged in the third primary fluid path; and a flow driving device configured to move fluid from the primary reaction chamber to the primary test part, wherein first buffer is configured to flush sample in the sample inlet through the second fluid path and into the primary reaction chamber, where the first buffer, the sample and a primary reaction material are mixed; and wherein the microfluidic test device comprises the primary reaction material in a lyophilized form, and wherein the primary reaction material and the first buffer are arranged on different, opposing sides of the sample inlet.

2. The microfluidic test device according to claim 1, wherein the primary reaction material is in a pellet form (cake) and/or coated to an inner surface of the microfluidic test device.

3. The microfluidic test device according to claim 1, wherein the primary reaction material is placed in the primary reaction chamber.

4. The microfluidic test device according to claim 1, wherein the primary reaction material components comprise primers, dNTPs, and a polymerase.

5. The microfluidic test device according to claim 1, wherein the primary reaction material comprises components for amplifying a nucleic acid target by loop-mediated isothermal amplification (LAMP).

6. The microfluidic test device according to claim 1, wherein the polymerase is a Bsm polymerase.

7. The microfluidic test device according to claim 1, wherein the Bsm polymerase is lyophilized substantially free of glycerol.

8. The microfluidic test device according to claim 1, wherein the primary reaction chamber is substantially free of liquid, such as a buffer, prior to feeding a sample into the device.

9. The microfluidic test device according to claim 1, wherein the primary reaction chamber is substantially free of $(NH4)_2SO_4$ and/or zwitterions (preferably betaine) prior to feeding a sample into the device.

10. The microfluidic test device according to claim 1, wherein the first buffer comprises $(NH4)_2SO_4$, a zwitterion (preferably betaine), and a biozide, wherein the biozide is ProClin950.

11. The microfluidic test device according to claim 1, wherein $Mg(SO_4)_7H_2O$ (magnesium sulfate heptahydrate) is present in both the primary reaction material and the first buffer in a ratio 1:3.

12. The microfluidic test device according to claim 5, wherein an amplification time of a LAMP reaction in the device is less than 1 hour.

13. The microfluidic test device according to claim 1, wherein a storage time of the device is at least 2 years from a production date at a storage temperature of 4-30° C.

* * * * *